US012741770B2

(12) United States Patent
Franzaroli

(10) Patent No.: US 12,741,770 B2
(45) Date of Patent: Sep. 22, 2026

(54) APPARATUS FOR PACKAGING ARTICLES

(71) Applicant: PULSAR S.R.L., Castel Maggiore (IT)

(72) Inventor: Massimo Franzaroli, Castel Maggiore (IT)

(73) Assignee: PULSAR S.R.L., Castel Maggiore (IT)

( * ) Notice: Subject to any disclaimer, the term of this patent is extended or adjusted under 35 U.S.C. 154(b) by 0 days.

(21) Appl. No.: 18/708,423

(22) PCT Filed: Nov. 10, 2022

(86) PCT No.: PCT/IB2022/060829
§ 371 (c)(1),
(2) Date: May 8, 2024

(87) PCT Pub. No.: WO2023/084440
PCT Pub. Date: May 19, 2023

(65) Prior Publication Data
US 2025/0074639 A1 Mar. 6, 2025

(30) Foreign Application Priority Data
Nov. 10, 2021 (IT) ..... 102021000028574

(51) Int. Cl.
*B65B 25/14* (2006.01)
*B65B 11/02* (2006.01)
(Continued)

(52) U.S. Cl.
CPC ..... *B65B 25/146* (2013.01); *B65B 11/02* (2013.01); *B65B 35/44* (2013.01); *B65B 43/52* (2013.01)

(58) Field of Classification Search
CPC ..... B65B 25/146; B65B 11/02; B65B 43/52; B65B 35/44
See application file for complete search history.

(56) References Cited

U.S. PATENT DOCUMENTS 5,433,063 A * 7/1995 Kovacs ..... B65B 25/146 53/550
7,114,609 B2 * 10/2006 Christman ..... B65G 47/648 198/442

(Continued)

FOREIGN PATENT DOCUMENTS

WO 2016135662 A1 9/2016
WO 2019123421 A1 6/2019

OTHER PUBLICATIONS

International Search Report dated Jul. 14, 2023 from counterpart PCT App No. PCT/IB2022/060829.

*Primary Examiner* — Andrew M Tecco
*Assistant Examiner* — Nicholas E Igbokwe
(74) *Attorney, Agent, or Firm* — SHUTTLEWORTH & INGERSOLL, PLC; Timothy J. Klima

(57) ABSTRACT

An apparatus for packaging articles to provide a corresponding package in the form of a secondary package, such as a bag, for example in plastic or paper film, a box, for example in cardboard or plastic material, and/or in the form of a tertiary package, such as a palletized load, includes a device for supplying the articles, a device for preparing a respective group of articles to be packaged, and a device for using the respective group of articles to be packaged, including a device for packaging the same group of articles to be packaged. The apparatus includes a plurality of independent, or discrete, modules, for the treatment of the articles, which treatment modules, are associated, in a sequential manner, or in succession, to one another to define the apparatus, especially to provide for the packaging of the articles, through the preparation of corresponding groups of articles.

17 Claims, 32 Drawing Sheets

(51) Int. Cl.
*B65B 35/44* (2006.01)
*B65B 43/52* (2006.01)

(56) References Cited

U.S. PATENT DOCUMENTS

| | | | | |
|---|---|---|---|---|
| 9,132,971 | B2 * | 9/2015 | Overly | B65B 35/50 |
| 10,112,776 | B2 * | 10/2018 | Rasi | B65G 47/841 |
| 2002/0108355 | A1 * | 8/2002 | Vignoli | B65B 5/067 53/459 |
| 2007/0125242 | A1 * | 6/2007 | Dall'Omo | B65B 25/146 99/450.4 |
| 2012/0321429 | A1 * | 12/2012 | Overley | B65B 25/146 28/100 |
| 2013/0334008 | A1 * | 12/2013 | Overley | B65D 71/063 206/391 |
| 2018/0029735 | A1 * | 2/2018 | Franzaroli | B65B 65/006 |
| 2018/0072552 | A1 * | 3/2018 | Orndorff | B65G 47/682 |
| 2018/0134425 | A1 * | 5/2018 | Grassi | B65B 11/04 |
| 2020/0339291 | A1 * | 10/2020 | Franzaroli | B65B 59/003 |

* cited by examiner

APPARATUS FOR PACKAGING ARTICLES

This application is the National Phase of International Application PCT/IB2022/060829 filed Nov. 10, 2022 which designated the U.S.

This application claims priority to Italian Application No. 102021000028574 filed Nov. 10, 2021, which application is incorporated by reference herein.

FIELD OF APPLICATION OF THE PRESENT INVENTION

The present invention relates to an apparatus for packaging articles.

STATE OF THE ART

In particular, in the Tissue industry, apparatuses for packaging articles are known, in particular in a secondary package, such as a bag, for example in plastic or paper film, in a box, for example in cardboard or plastic material, and/or in a tertiary package, such as a palletized load, and in which said articles are composed of a corresponding package of products, in particular in the form of a primary package, and are in the form of packets, envelopes, packs, boxes, or similar packages, for example in plastic or paper film, and in which said products are in the form of rolls, small rolls napkins, tissues, hand and face wipes, hand towels, sheets and other.

These already-known apparatuses are generally in the form of compact equipment that comprise means for supplying said articles, means for preparing a respective group of articles to be packaged, in which said group of articles to be packaged comprises one or more articles, and means for the direct packaging of the same group of articles to be packaged.

A felt drawback in relation to said already-known equipment packaging relates to the fact that this equipment is not very flexible to use and, furthermore, take a long time to allow for a very limited format change.

Moreover, said already-known packaging equipment does not allow packaging articles that are different from each other and that are positioned differently within the same package; therefore, they are not very suitable for the packaging of products in the sorting centres of e-commerce companies, i.e., which carry out sales via the Internet, which must send products to single users who are different from one another, possibly without wasting space inside the corresponding transport packages.

Furthermore, said already-known packaging equipment is excessively bulky and requires a lot of available space for its installation within the plant in which it is used, and therefore leads to excessively high plant costs.

Moreover, said already-known packaging equipment has a productivity and a working speed that are overall too limited.

SUMMARY OF THE INVENTION

Therefore, with the present invention it is desired to propose a new, alternative solution to the solutions known so far, and in particular it is proposed to obviate one or more of the drawbacks or problems referred to above and/or to meet one or more of the needs referred to above, and/or however felt in the art, and in particular deducible from the above.

Therefore, an apparatus for packaging articles is provided, in particular to provide for a corresponding package, in particular in the form of a secondary package, such as a bag, for example in plastic or paper film, a box, for example in cardboard or plastic material, and/or in the form of a tertiary package, such as a palletized load; especially said articles being composed of a corresponding package, in particular a primary package, of one or more products, and preferably being in the form of packets, envelopes, packs, boxes or similar packages, for example in plastic or paper film; preferably said products being in the form of products of the so-called Tissue sector and in particular being in paper material or another material, such as a fabric or a non-woven fabric or other; especially said products being in the form of rolls, small rolls napkins, tissues, hand and face wipes, hand towels, sheets and other, and preferentially said rolls being in the form of rolls of toilet paper, kitchen paper or wiping paper, or for another use, i.e., of rolls in film for food, such as rolls of aluminium foil, in plastic film, in film of parchment or wax paper and the like; the apparatus comprises means for supplying said articles, means for preparing a respective group of articles to be packaged, and means for using the respective group of articles to be packaged, in particular comprising packaging means of the same group of articles to be packaged; characterized in that the apparatus comprises a plurality of independent, or discrete, modules, or units for the treatment of said articles, which treatment modules, or units, are associated, in particular in a sequential manner, or in succession, to one another to define the same apparatus, especially to provide for the packaging of the same articles, through the preparation of corresponding groups of articles.

In this manner, an apparatus particularly flexible to use is achieved. In fact, by combining the different modules, it is possible to make an apparatus that is easily configured as a function of the specific needs of the users of the same apparatus. In particular, said apparatus can be suitably configured as a function of the available space for the installation thereof inside the plant of use. Furthermore, the productivity or working speed can be suitably varied by adding or removing corresponding modules to the same apparatus.

BRIEF DESCRIPTION OF THE DRAWINGS

This and other novel aspects, or respective advantageous implementations, are however set forth in the attached claims, the specific technical characteristics of which can be found, together with corresponding advantages obtained, in the following description, illustrating in detail merely exemplary, non-limiting embodiments of the invention, and which is made with reference to the attached drawings, in which:

DETAILED DESCRIPTION OF PREFERRED IMPLEMENTATIONS OF THE INVENTION

Figure 3:
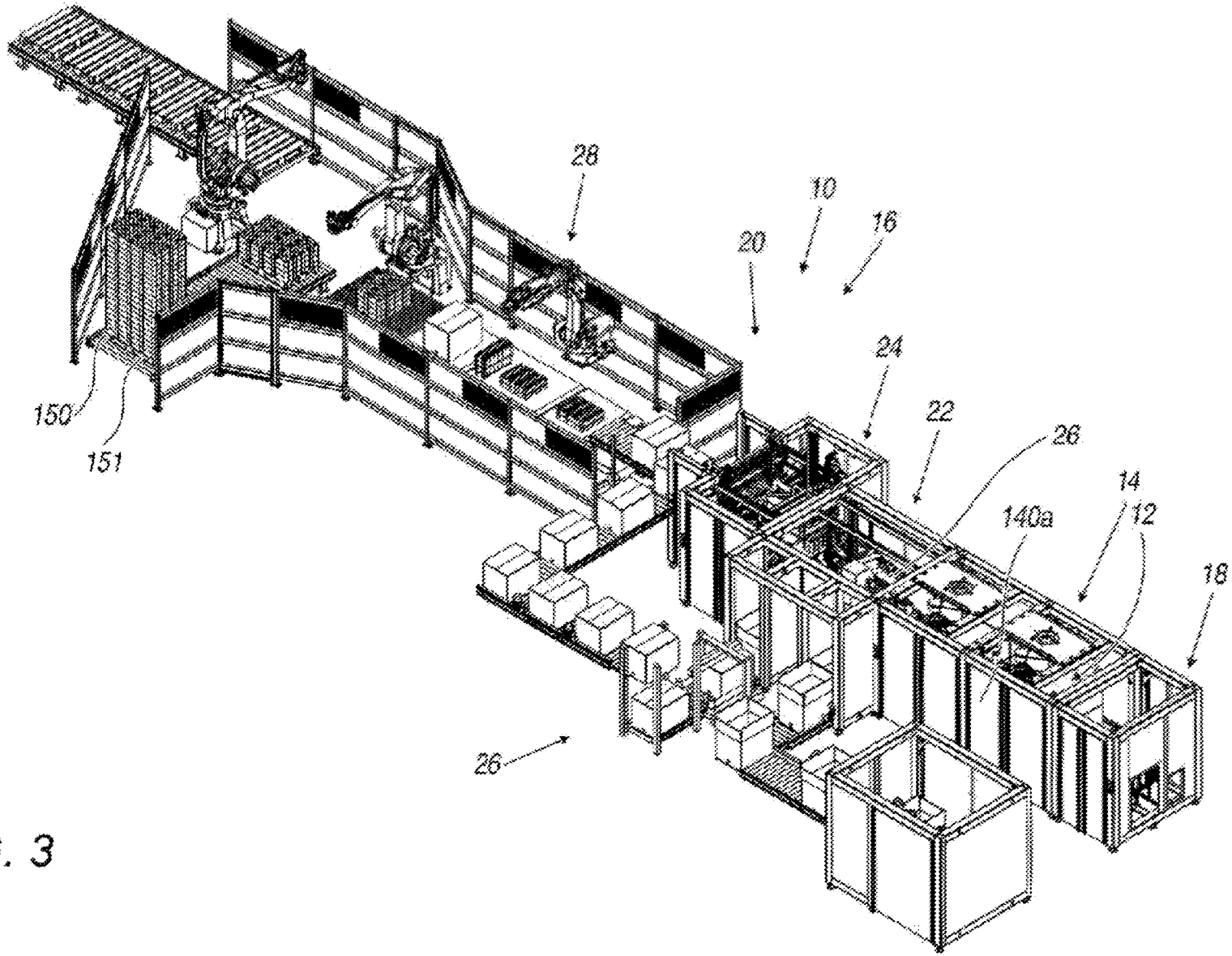
FIG. 3 illustrates a schematic, perspective view of a first preferred implementation of apparatus according to the present invention, in particular configured in accordance with a first version of the same implementation of apparatus.
Figure 4A:
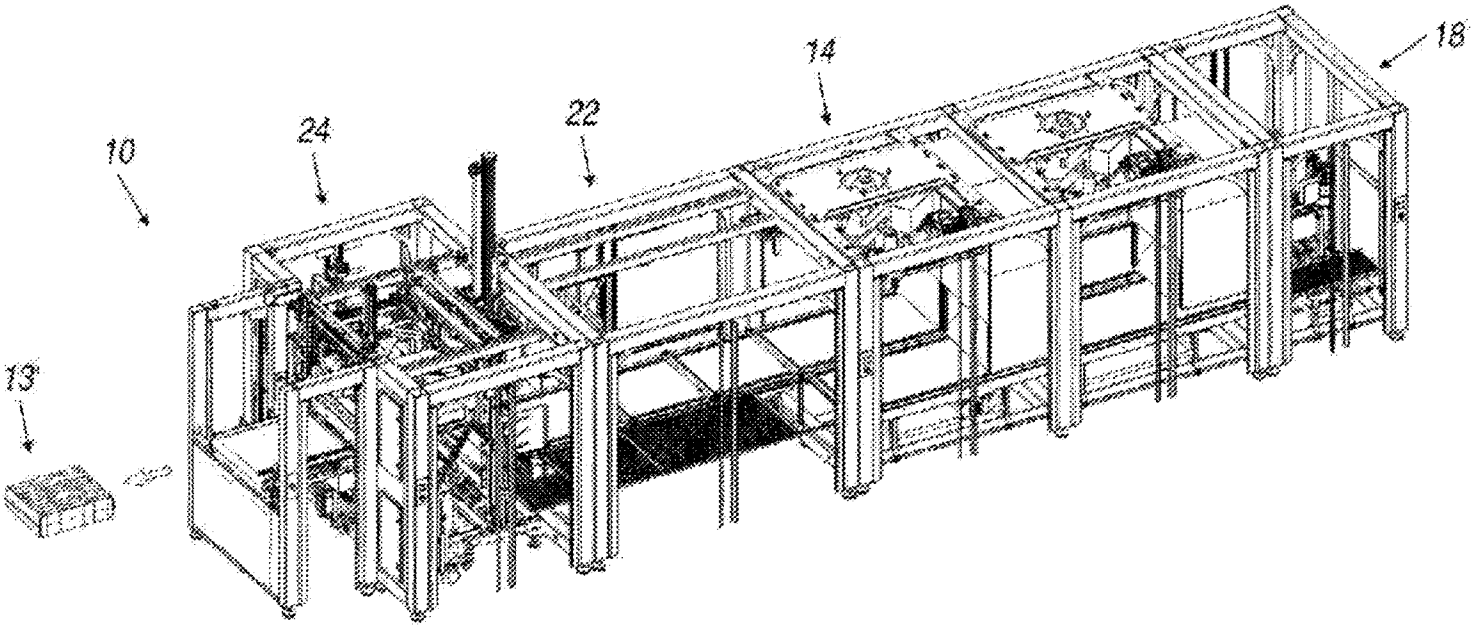
FIG. 4A illustrates a schematic, perspective view of the first preferred implementation of apparatus according to the present invention, in particular configured in accordance with a second version of the same implementation of apparatus.
Figure 4B:
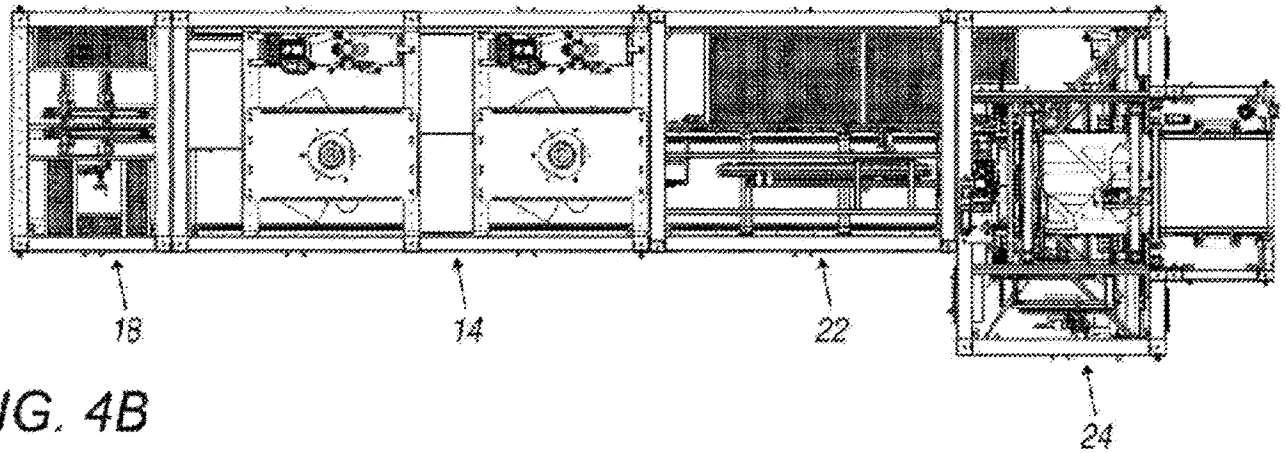
FIG. 4B illustrates a schematic, top plan view of the first preferred implementation of apparatus according to the present invention, in particular configured in accordance with the second version of the same implementation of apparatus.
Figure 5:
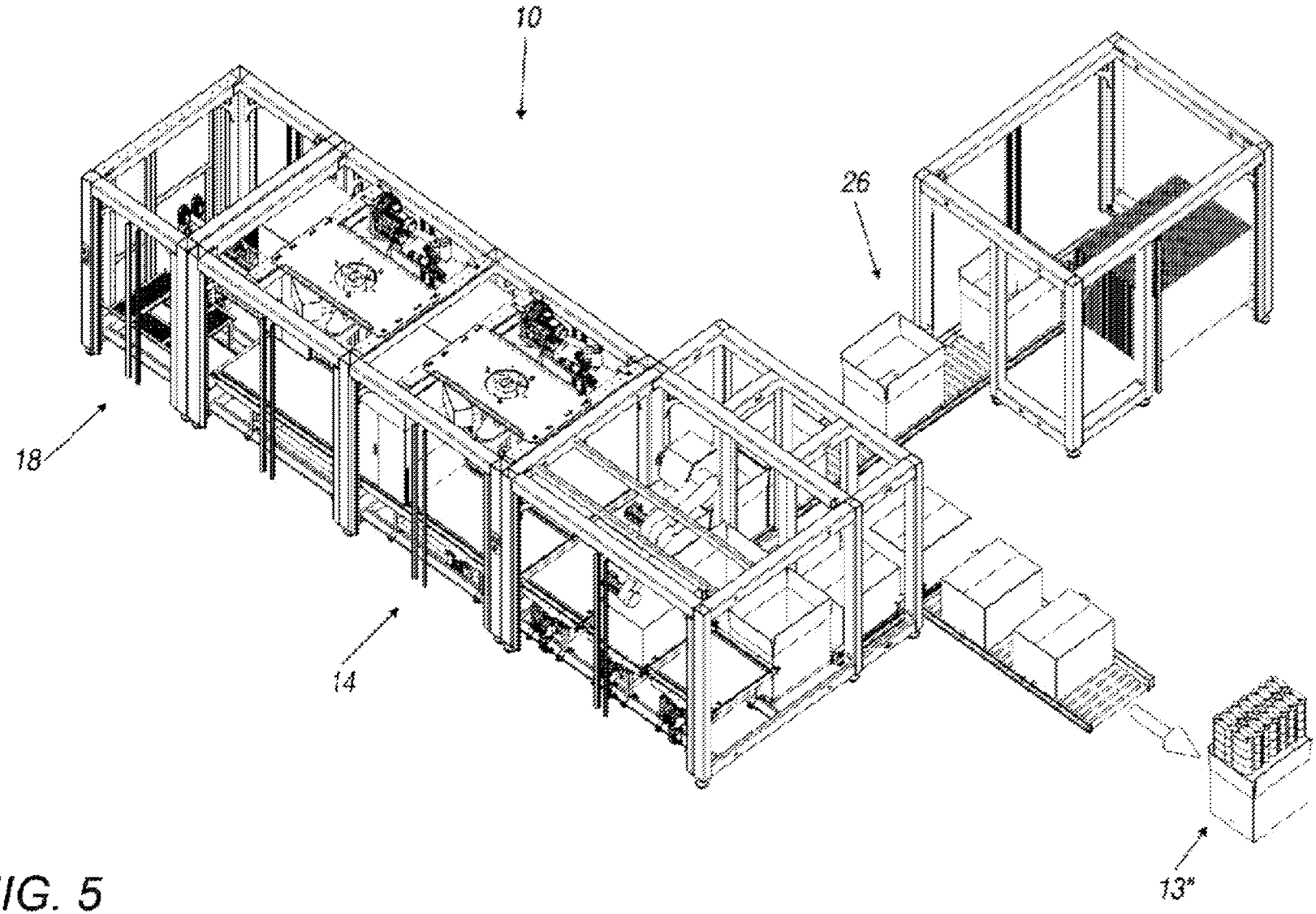
FIG. 5 illustrates a schematic view of the first preferred implementation of apparatus according to the present invention, in particular configured in accordance with a third version of the same implementation of apparatus.

In the attached FIGS. 3 to 5, a first preferred implementation of apparatus 10 for packaging articles 11 is illustrated in three different versions of use.

Figure 1A:
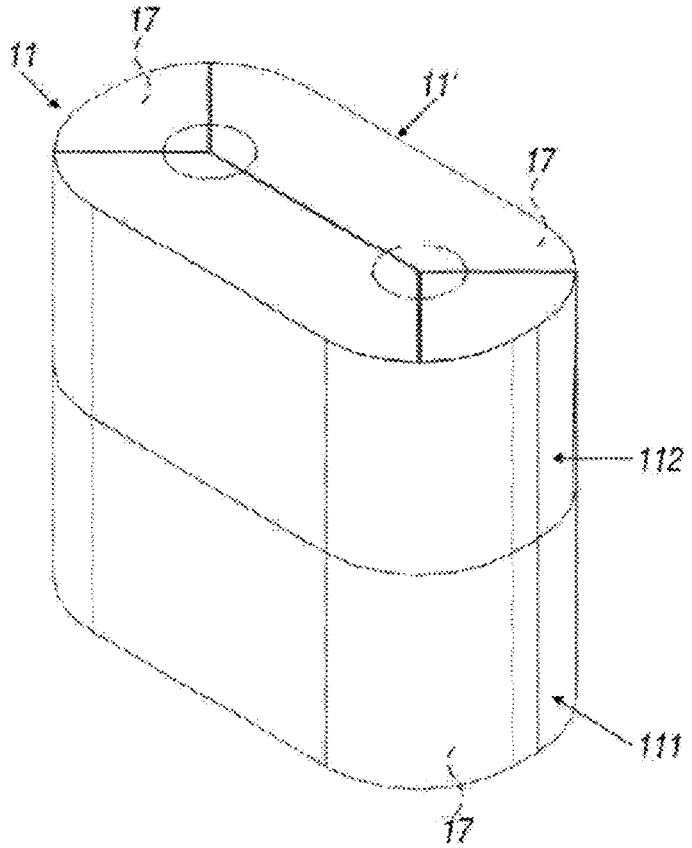
FIG. 1A illustrates a schematic, perspective view of a first exemplary embodiment of an article to be packaged, in particular in the form of a corresponding packet of toilet paper rolls.
Figure 1B:
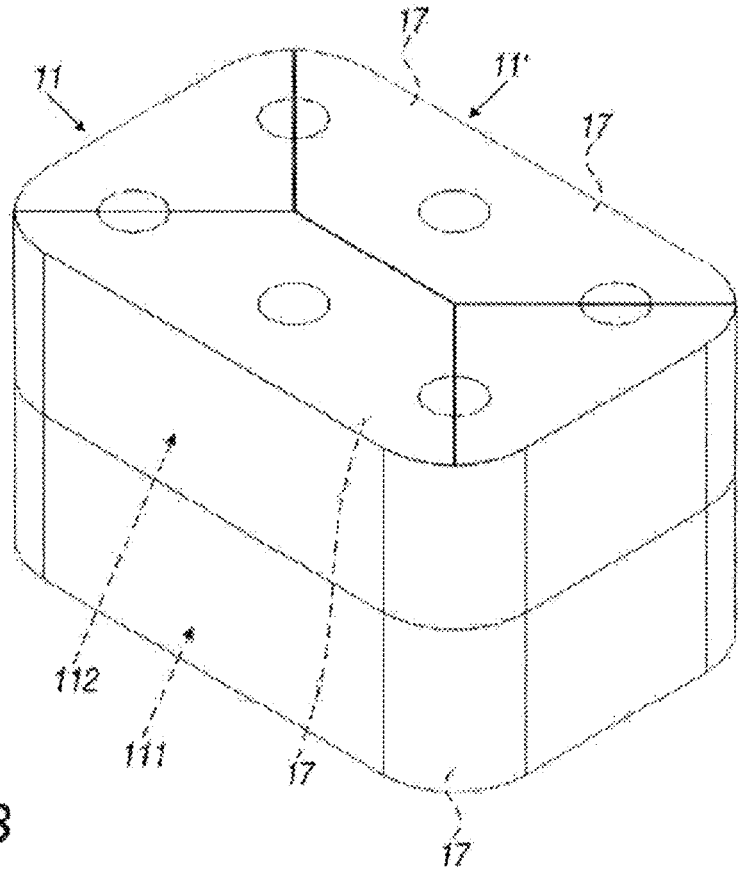
FIG. 1B illustrates a schematic, perspective view of a first exemplary embodiment of an article to be packaged, in particular in the form of a further packet of toilet paper rolls.
Figure 1C:
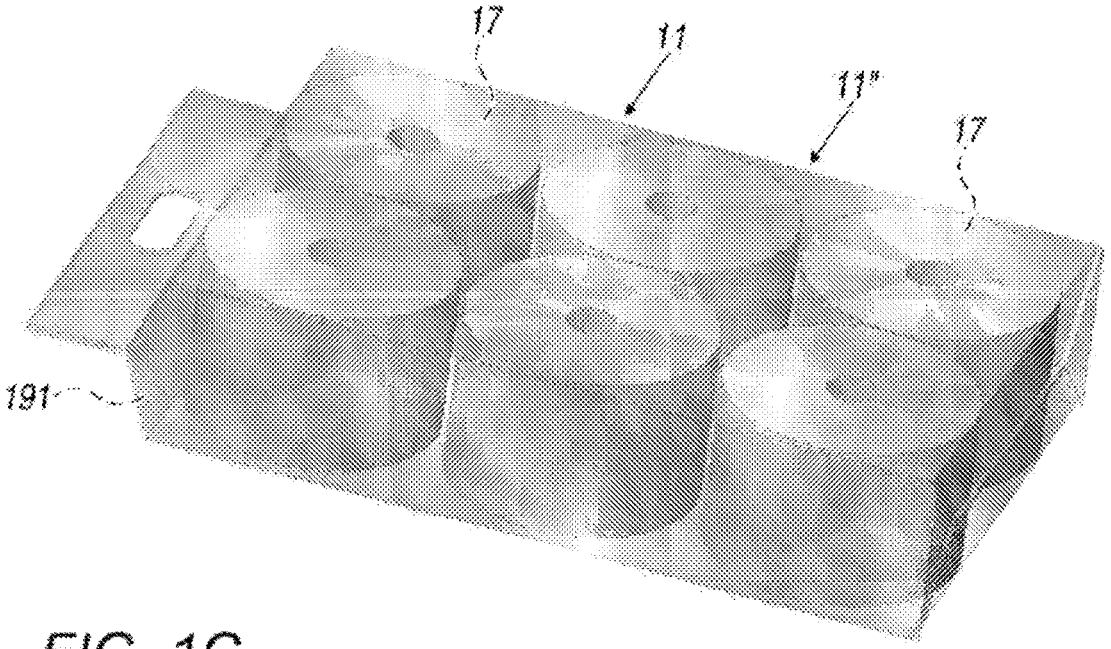
FIG. 1C illustrates a schematic, perspective view of a third exemplary embodiment of an article to be packaged, in particular in the form of a corresponding envelope di large rolls of toilet or kitchen paper.

Said articles 11 are by way of example illustrated in the FIGS. 1A to 1C, and can be a packet, an envelope, or other, as in any case is best seen from the following of the present description.

Figure 2A:
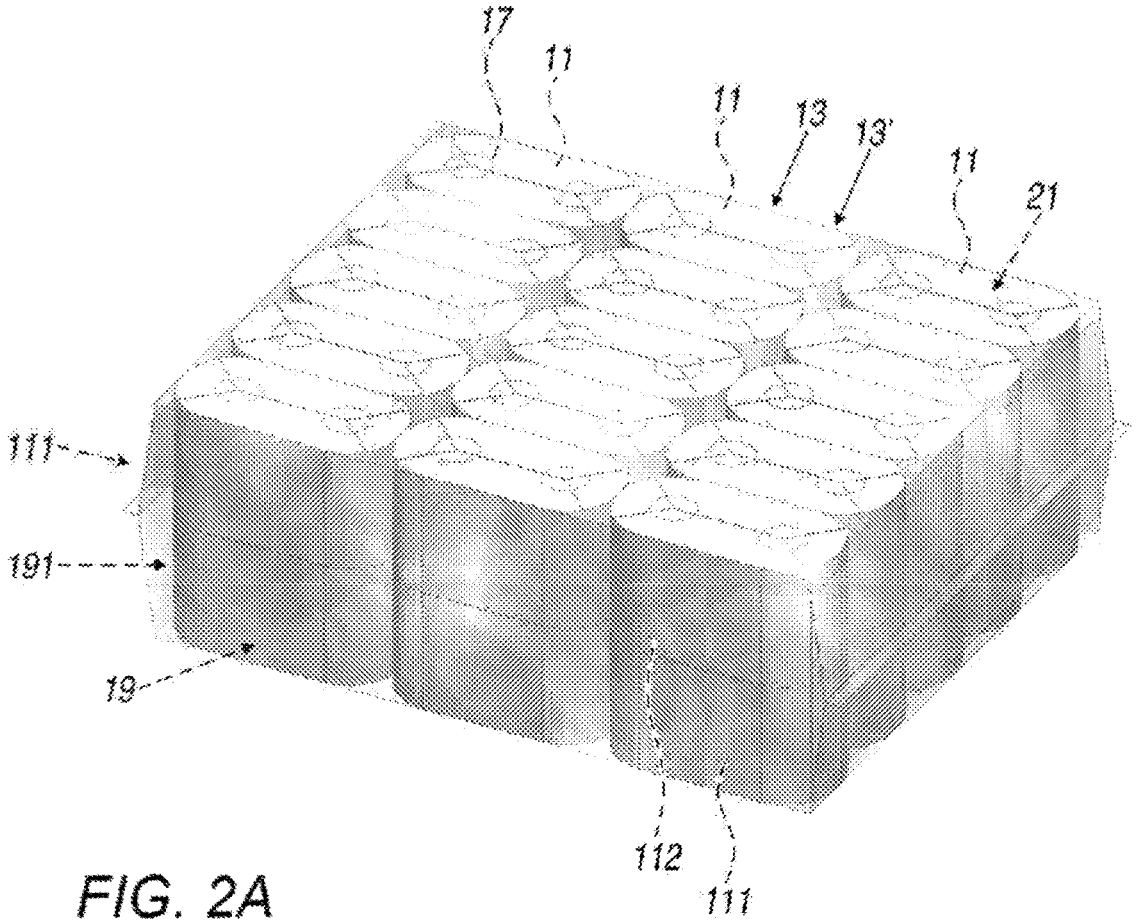
FIG. 2A illustrates a schematic, perspective view of a first preferred implementation of package, in particular in the form of a bag of packets of toilet paper rolls, that can be obtained with the apparatus according to the present invention.
Figure 2B:
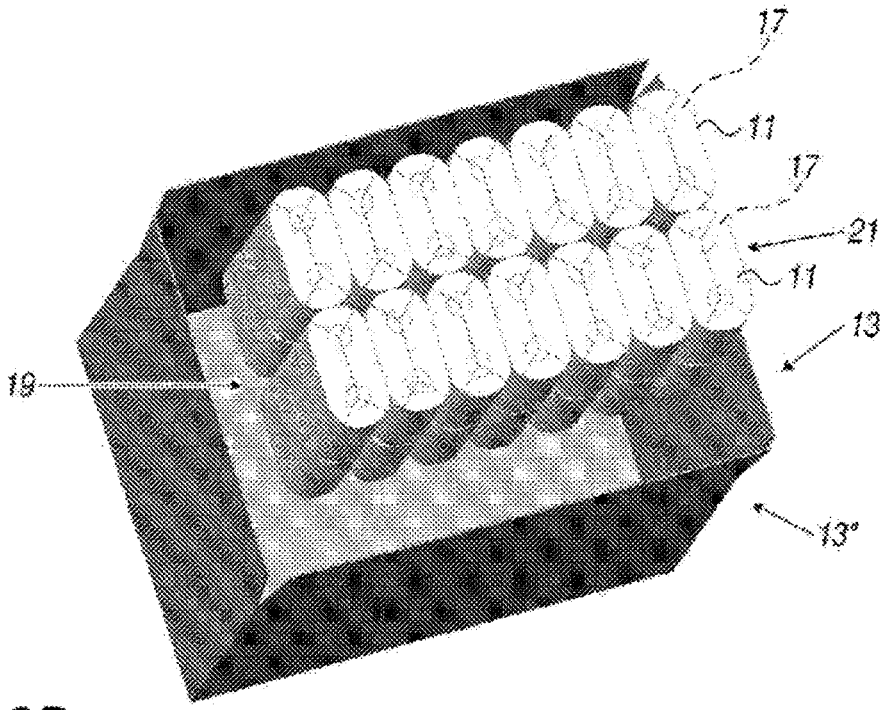
FIG. 2B illustrates a schematic, perspective view of a second preferred implementation of package, in particular in the form of a box for holding packets of toilet paper rolls, that can be obtained with the apparatus according to the present invention.
Figure 2C:
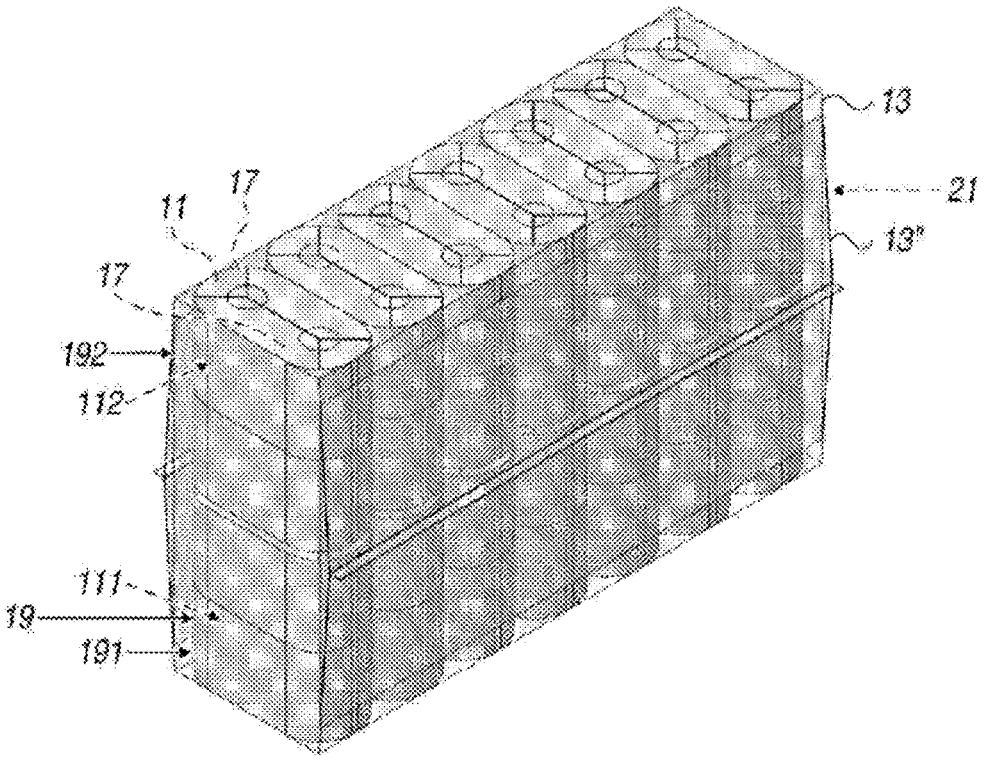
FIG. 2C illustrates a schematic, perspective view of a third preferred implementation of package, in particular in the form of a bag of packets of toilet paper rolls, in a stacked or overlapping condition, that can be obtained with the apparatus according to the present invention.
Figure 2D:
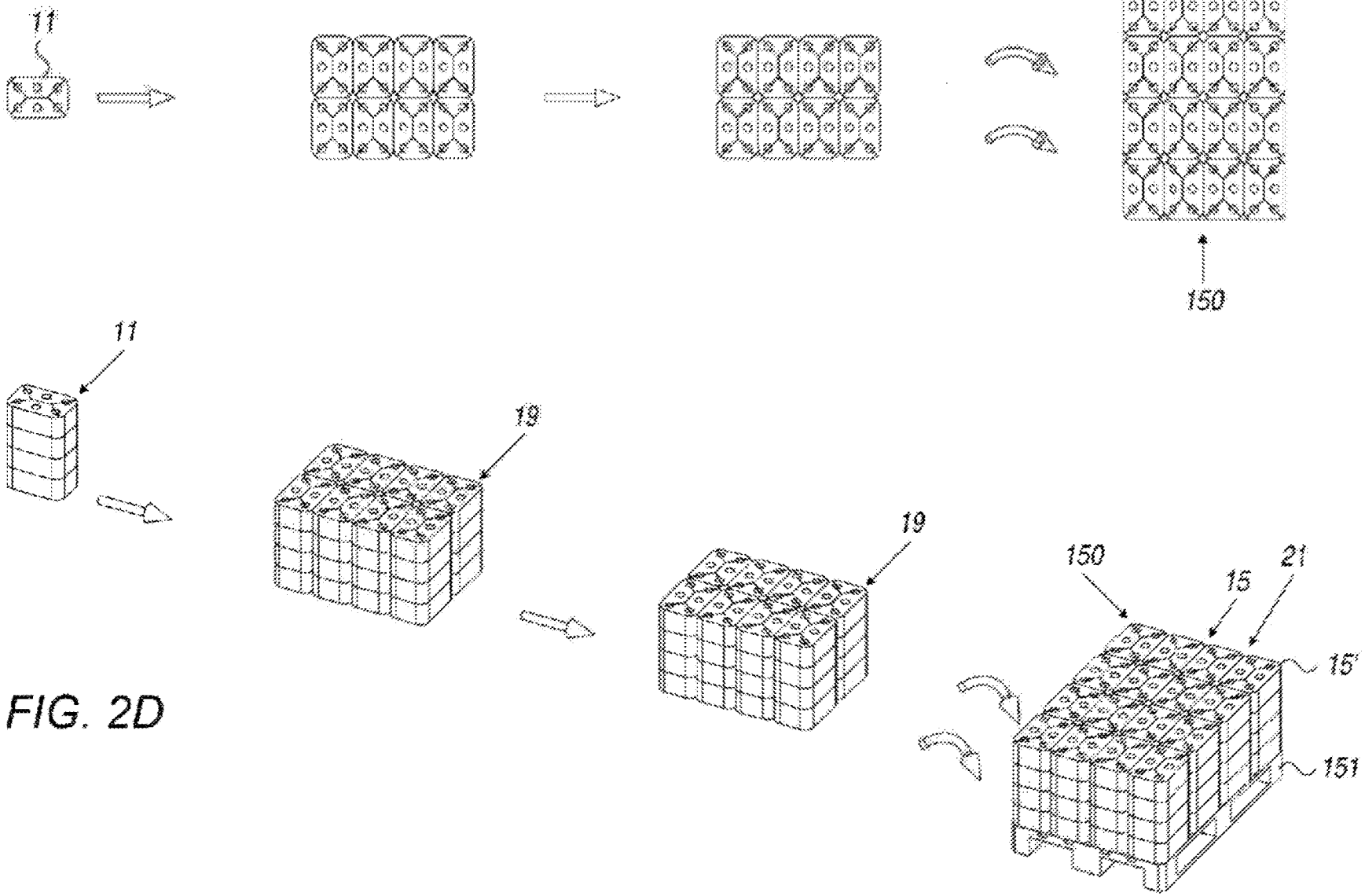
FIG. 2D illustrates in respective top and schematic perspective views a fourth preferred implementation of package, in particular in the form of a pallet of packets of toilet paper rolls, that can be obtained with the apparatus according to the present invention.

In particular, the apparatus is adapted to provide for a corresponding package 13 and/or 15, which is in particular in the form of a secondary package 13, such as a bag 13', for example in plastic or paper film, as best seen from FIGS. 2A and 2C, a box 13", for example in cardboard or plastic material, as is clear from FIG. 2B, and/or is in the form of a tertiary package 15, such as a palletized load 15', i.e., a load 150, which is carried by a corresponding support pallet 151, as best seen from FIG. 2D.

Furthermore, as illustrated, the package 13 and/or 15 can comprise one or more layers 111, 112 of said articles.

Preferably, said articles 11 are composed of a corresponding package of one or more products 17, in particular a primary package, and being in the form of packets 11', envelopes 11", packs, boxes, or similar packages, for example in plastic or paper film, and in which preferentially are in direct contact with the respective product 17.

In turn, said products 17 are preferably in the form of products of the so-called Tissue sector and preferably are in paper material or another material, such as a fabric or a non-woven fabric or other.

Furthermore, said products 17 are preferentially in the form of rolls, small rolls napkins, tissues, hand and face wipes, hand towels, sheets and other, and in particular said rolls are in the form of rolls of toilet paper, kitchen paper or wiping paper, or for another use, i.e., of rolls in film for food, such as rolls of aluminium foil, in plastic film, in film of parchment or wax paper and the like.

As best seen from the subsequent figures and in particular from FIG. 3, in accordance with a first preferred implementation 10, the apparatus comprises means, or a respective line, 12 for supplying said articles 11, in particular mutually aligned according to one or more supplying rows, especially extending mutually parallel, as in any case is best seen from the following of the present description, and means 14 for preparing a respective group 19 of articles to be packaged. Preferably, as illustrated, the group of articles to be packaged 19 comprises one or more articles 11, and in particular has the articles 11 ordered according to one or more longitudinal and/or transversal rows, especially with the respective row having one or more articles 11. Preferably, furthermore, the articles 11 of the group 19 are mutually adjacent, and preferably, contacting one another, and with said group of articles to be packaged 19 being preferably composed of articles 11 arranged on a single layer, or possibly also on multiple layers 191, 192 overlapping one another.

In particular, the group of articles to be packaged 19 can be adapted to directly define a final group of articles to be packaged, or bundle, 21, as is clear for example from the FIGS. 2A to 2C, or said group of articles to be packaged 19 can be adapted to define, or to be subdivided into, a plurality of final groups of articles to be packaged, or bundles, 21, for example being able to be divided into a first and a second groups of articles to be packaged, or bundles, 21, or also said group of articles to be packaged 19 can be adapted to define a part of a final group of articles to be packaged, or bundle, 21, for example two groups of articles 19 may define said final group of articles to be packaged, or bundle, 21, such as for example is clear from FIG. 2D.

Furthermore, as illustrated, the apparatus 10 further comprises means for using 16 for using the respective group of articles to be packaged 19, which means for using 16, in a preferred manner, as illustrated herein, comprise packaging means 20 of the same group of articles to be packaged 19, as described below.

With advantage, as illustrated, the apparatus 10 comprises a plurality of independent, or discrete, modules, or units 14, 18, 22, 24, 26 for the treatment of said articles 11, which treatment modules, or units, 14, 18, 22, 24, 26 are associated, in particular in a sequential manner or in a succession to one another, to define the same apparatus 10, especially to provide for the packaging of the same articles 11, through the preparation of corresponding groups of articles 19.

In this manner, an apparatus particularly flexible to use is achieved.

In fact, by combining the different modules, it is possible to make an apparatus that is easily configured as a function of the specific needs of the users of the same apparatus.

In particular, said apparatus can be suitably configured as a function of the available space for the installation thereof inside the plant of use.

Furthermore, the productivity or working speed can be suitably varied by adding or removing corresponding modules to the same apparatus.

As is clear from said figures, advantageously, in practice, as in any case is best seen from the following of the present description, the respective treatment module, or unit 14, 18 defines, or comprises, respective means 12 for supplying said products to be packaged.

In an advantageous manner, as is clear from said figures, in practice, as in any case is best seen from the following of the present description, the respective treatment module, or unit 14, 18 comprises a respective, and in particular autonomous, supporting frame of the respective means 12 for supplying said products to be packaged.

In a further advantageous manner, as is clear from said figures, in practice, as in any case is best seen from the following of the present description, the respective treatment module, or unit 14, 18 defines, or comprises, at least one respective inlet and one respective outlet for respective articles 11 and/or corresponding groups of articles 19, in particular the outlet of a respective module, or unit, being interfaced, or connected, with the inlet of a corresponding and subsequent module, or unit.

As is clear from said figures, advantageously, the respective treatment module, or unit 14, 18 defines, or comprises, at least one respective outlet for respective articles 11 that are not used by the same module, or unit as in any case is best seen from the following of the present description.

In a particularly advantageous manner, as is clear from said figures, as in any case is best seen from the following of the present description, the respective treatment module, or unit 14 comprises, or supports, means 1400 for detecting said articles 11 and/or said groups of articles to be packaged 19, in particular for the control thereof, i.e., for detecting the arrangement or configuration of said articles 11 and/or of said group of articles to be packaged 19 being formed, and possibly also usable for detecting any defects of said articles 11 and/or the respective group of articles to be packaged 19.

Figure 6A:
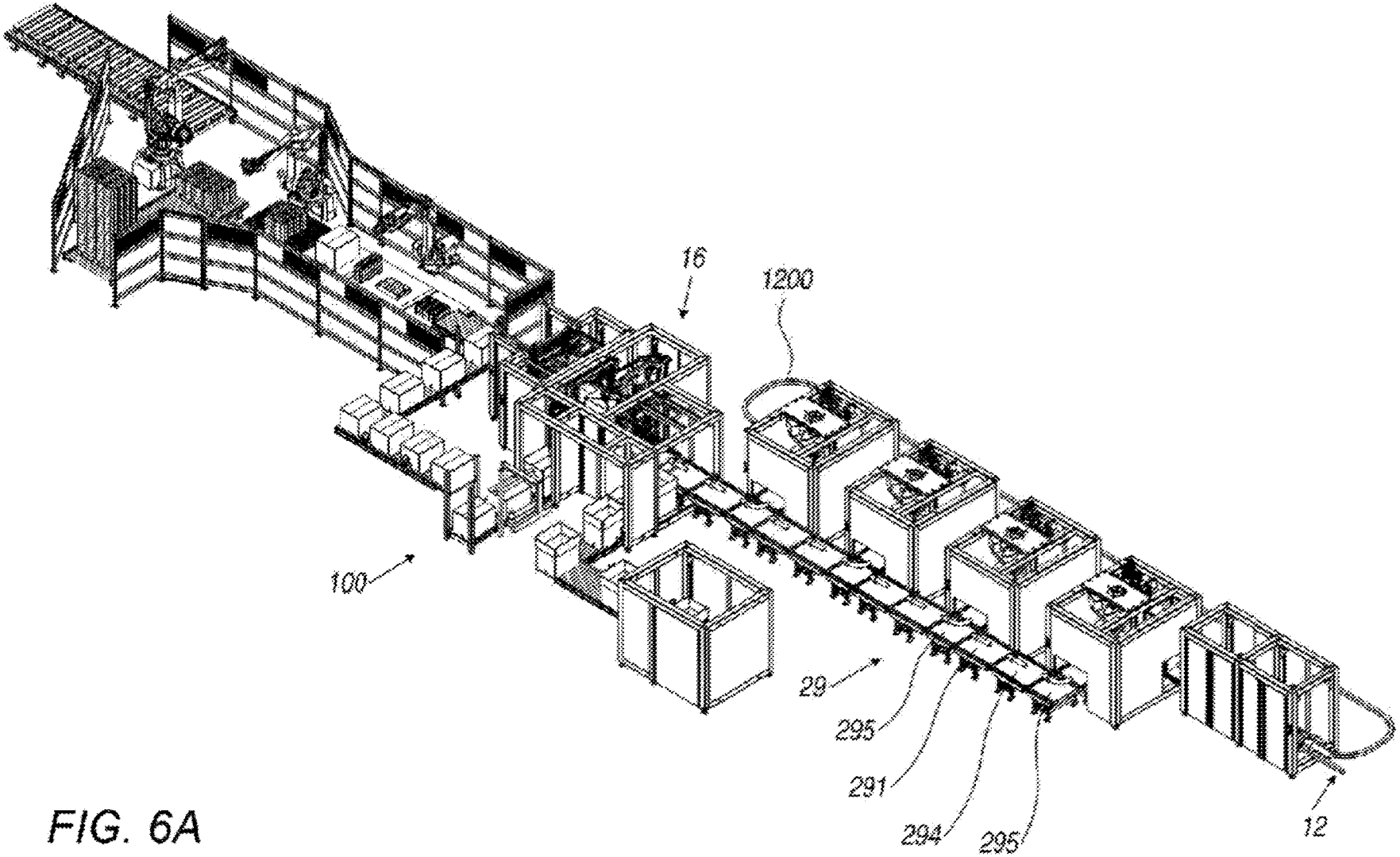
FIG. 6A illustrates a schematic, perspective view of a second preferred implementation of apparatus according to the present invention, in particular configured in accordance with a first version of the same implementation of apparatus.
Figure 6B:
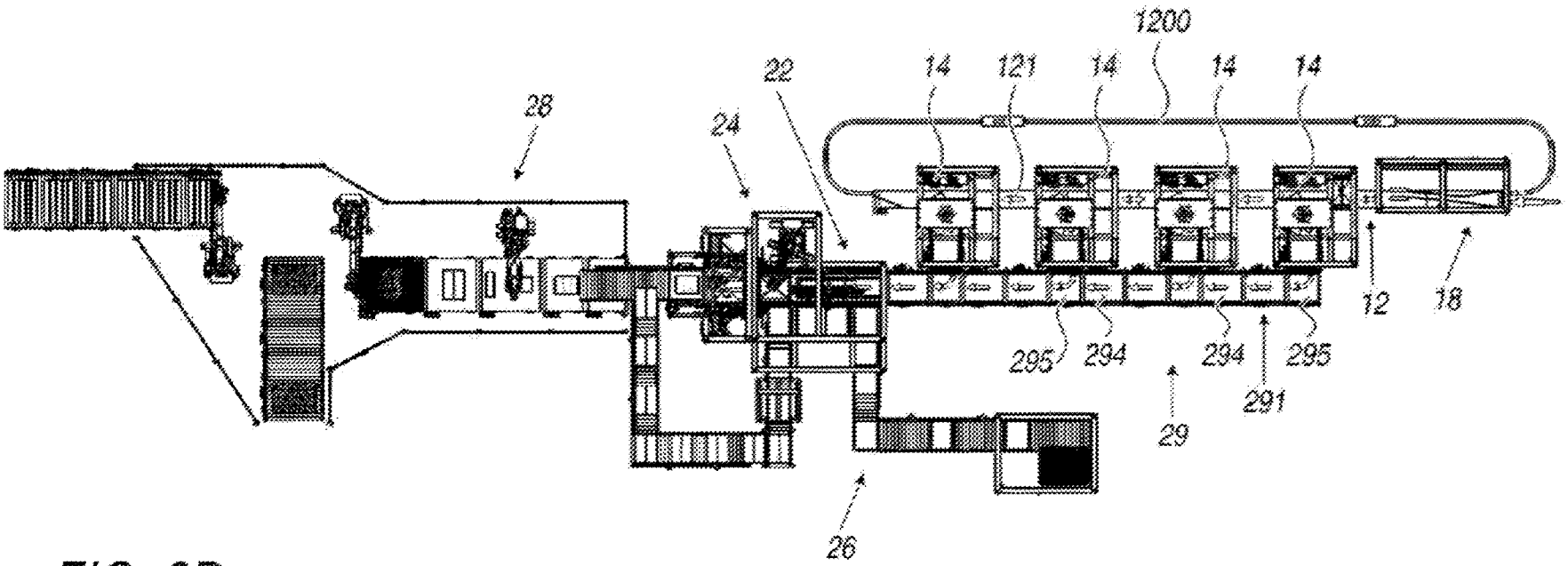
FIG. 6B illustrates a schematic, top plan view of the second preferred implementation of apparatus according to the present invention, in particular configured in accordance with the first version of the same implementation of apparatus.

In a particularly advantageous manner, as is clear in particular from the FIGS. 6A and 6B, as in any case is best seen from the following of the present description, means 1200 are provided, for the recirculation on said same means 12 for supplying said products to be packaged of said unused articles 11, in particular by said means 14 for preparing a respective group of articles to be packaged 19, in particular, according to a respective and advantageous embodiment, at least partially supported on corresponding operative modules 14 of the apparatus.

As is clear from said FIGS. 3 to 10B, advantageously, said means 14 for preparing a respective group of articles to be packaged 19, used in the present apparatus, comprise one or more modules, or units, 14 adapted to prepare a respective group of articles to be packaged 19.

In this manner, an apparatus can be achieved, which is particularly versatile and adaptable as desired to the specific needs of the users.

In particular, even after the installation, the present apparatus can be easily modified to meet new and emerging needs of use, especially adding or removing respective modules 14.

In an appreciably advantageous manner, as is clear in particular from said FIGS. 8A to 10B, said module, or unit 14 for the preparation of a respective group of articles to be packaged 19 comprises a respective supporting frame 140, in particular which supporting frame 140 has a respective bearing framework, preferably comprising corresponding supporting section bars, preferentially made of metal, mutually connected, which frame 140 is preferably inferiorly resting on the ground through corresponding support feet 140*p*.

In an appreciably advantageous manner, as is clear in particular from said FIGS. 8A to 10B, said supporting frame 140, in particular in a quadrangular configuration, i.e., having a quadrangular plant, is in any case configured so as to have a front longitudinal side 140*a*, a rear longitudinal side 140*b*, a head transversal side 140*c*, especially facing, in use, a corresponding module, or unit arranged upstream of said apparatus 10, a tail transversal side 140*d*, especially facing, in use, a corresponding module, or unit, arranged downstream of said apparatus 10, and an upper side 140*e* facing upwards, and in particular that closes superiorly the same module, or unit, 14.

As is clear in particular from said FIGS. 8A to 9D, advantageously, in accordance with a prima and a second preferred implementation of said module, or unit 14 for the preparation of a respective group of articles to be packaged 19, said supporting frame 140 is at least partially open on a respective side, in particular on the head transversal side 140*c*, to define the inlet 14*ae* of corresponding articles 11 being supplied, and possibly the inlet 14*ge* of corresponding groups of articles to be packaged 19, or parts thereof, which are passing, or are further processed through, or by the same module, or unit, 14, and is at least partially open on a respective side, in particular on the tail transversal side 140*d* to define the outlet 14*gu* of corresponding groups of articles to be packaged 19, or parts thereof, and possibly the outlet 14*au* of corresponding articles 11 that are not used by the same module, or unit 14.

In particular, it shall be understood that the present module, or unit, 14 is devised so that it can achieve corresponding complete groups of articles to be packaged 19, or so that it can achieve only a part of said groups to be packaged 19, which are thus completed respectively by virtue of a plurality, for example in a number of two, of preparation modules, or units 14.

As illustrated, in these first and second preferred implementations of said module, or unit 14 for the preparation of a respective group of articles to be packaged 19, said longitudinal, respectively front and rear, sides 140*a*, 140*b* are closed by corresponding panels, which are preferably transparent, and which preferably can be opened to allow the access of personnel to the inside of the same module, or unit, 14, in particular for maintenance or reactivation purposes.

Figure 10A:
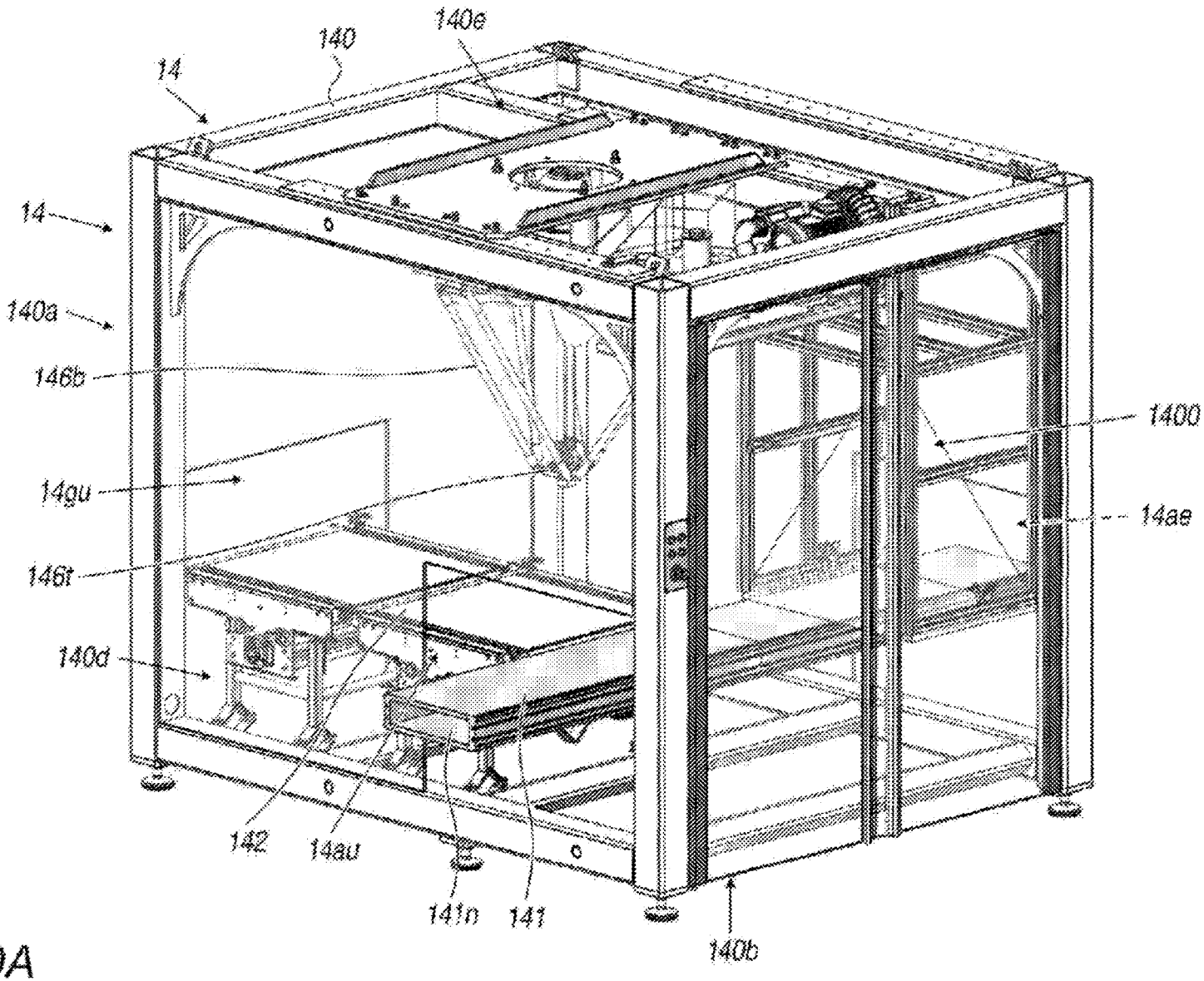
FIG. 10A illustrates a schematic, perspective view of a third preferred implementation of module for the preparation of a respective group of articles to be packaged, which can be used in the apparatus according to the present invention.
Figure 10B:
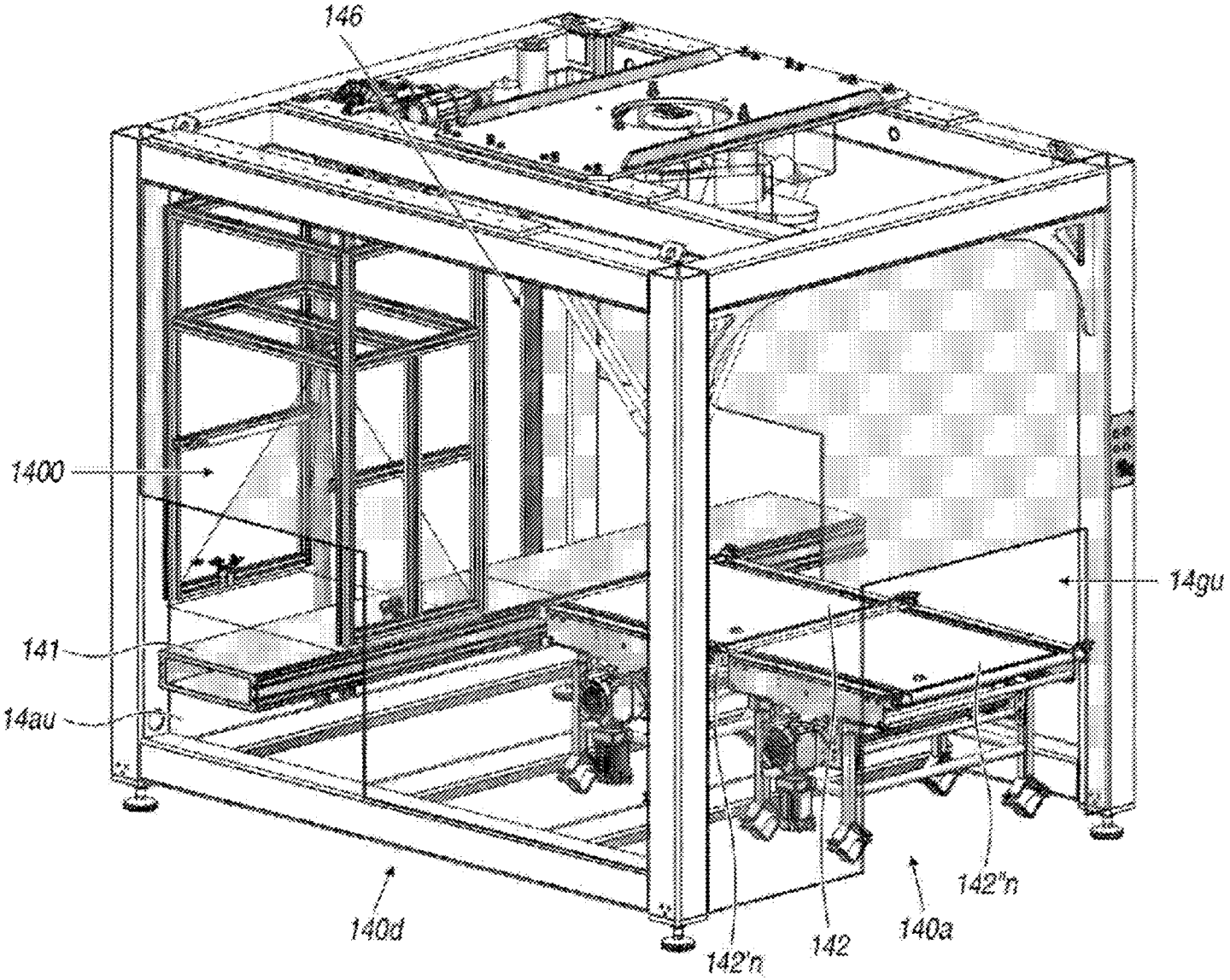
FIG. 10B illustrates a schematic, perspective view, taken from a different direction than that of FIG. 10A, of the third preferred implementation of module for the preparation of a respective group of articles to be packaged, which can be used in the apparatus according to the present invention.

With appreciable advantage, as is clear in particular from said FIGS. 10A and 10B, in accordance with a third preferred implementation of said module, or unit 14 for the preparation of a respective group of articles to be packaged 19, said supporting frame 140 is at least partially open on a respective side, in particular on the respective head transversal side 140*c*, to define the inlet 14*ae* of corresponding articles 11, and is at least partially open on a respective side, in particular on a respective longitudinal side, preferably on the front longitudinal side 140*a*, to define the outlet 14*gu* of said group of articles to be packaged 19, and is furthermore at least partially open on a respective side, in particular on the tail transversal side 140*d* to define the outlet 14*au* of corresponding articles 11, that are not used by the same module, or unit 14.

As illustrated, in this third preferred implementation of said module, or unit 14 for the preparation of a respective group of articles to be packaged 19, said rear longitudinal side 140*b* is closed by one or more panels, which are preferably transparent, and which preferably can be opened to allow the access to the inside of the same module, or unit, 14.

With appreciable advantage, as is clear in particular from said FIGS. 8A to 10B, said module, or unit 14 for the preparation of a respective group of articles to be packaged 19 comprises a respective surface 141 for supporting said articles 11 in the supplying thereof, which in particular extends, preferably longitudinally, between said inlet 14*ae* and said outlet 14*au* for the same articles 11.

Advantageously, as is clear in particular from said FIGS. 8A to 10B, said surface for supporting said articles 11 in the supplying thereof is defined by a corresponding upper face 141 of a corresponding conveyor, in particular in the form of a conveyor belt 141*n*, which is especially adapted to supply said articles 11 according to a respective longitudinal direction.

With advantage, as is clear from said FIGS. 8A to 10B, said conveyor, in particular in the form of a conveyor belt 141*n*, especially adapted to supply said articles 11 according to a respective longitudinal direction, i.e., the respective upper surface thereof 141, extends between said inlet 14*ae* and said outlet 14*au* for said articles 11 in the supplying thereof.

With advantage, as is clear in particular from said FIGS. 8A to 9D, in accordance with the first and the second preferred implementations of said module, or unit 14 for the preparation of a respective group of articles to be packaged 19, said module, or unit 14 for the preparation of a respective group of articles to be packaged 19 comprises a surface 142 for supporting said group of articles to be packaged 19, in particular which surface 142 extends, preferably longitudinally, between said inlet 14*ge* and said outlet 14*gu* for the same group of articles to be packaged 19.

Advantageously, as is clear in particular from said FIGS. 8A to 9D, in said first and second preferred implementations of said module, or unit 14 for the preparation of a respective group of articles to be packaged 19, said surface for supporting said group of articles to be packaged 19 is defined by a corresponding upper face 142 of a corresponding conveyor, in particular in the form of a conveyor belt 142*n*, especially adapted to move the respective group of articles to be packaged 19 forward according to a respective longitudinal direction.

In an advantageous manner, as is clear in particular from said FIGS. 8A to 9D, in said first and second preferred implementations of said module, or unit 14 for the preparation of a respective group of articles to be packaged 19, said conveyor, in particular in the form of a conveyor belt 142*n*, especially adapted to supply the respective said group of articles to be packaged 19 according to a respective longitudinal direction, i.e., the respective upper surface thereof 142, extends longitudinally between said inlet 14*ge* and said outlet 14*gu* for the respective group of articles to be packaged 19.

In an advantageous manner, as is clear in particular from said FIGS. 10A and 10B, in said third preferred implementation of said module, or unit 14 for the preparation of a respective group of articles to be packaged 19, said module, or unit 14 for the preparation of a respective group of articles to be packaged 19 comprises a surface 142 for supporting said group of articles to be packaged 19, which in particular extends, preferably transversally, from said surface 141 for supporting said articles 11 in the supplying thereof to said outlet 14*gu* for the same group of articles to be packaged 19.

Advantageously, as is clear in particular from said FIGS. 10A and 10B, in said third preferred implementation of said module, or unit 14 for the preparation of a respective group of articles to be packaged 19, said surface for supporting said group of articles to be packaged 19 is defined by a corresponding upper face 142 of a corresponding conveyor, in particular in the form of a conveyor belt 142'*n*, especially adapted to move the respective group of articles to be packaged 19 forward according to a respective transversal direction.

In a particularly advantageous manner, as is clear in particular from said FIGS. 10A and 10B, in said third preferred implementation of said module, or unit 14 for the preparation of a respective group of articles to be packaged 19, a conveyor is provided for, in particular in the form of a conveyor belt 142"*n*, in particular adapted to move the respective group of articles to be packaged 19 forward according to a respective transversal direction, i.e., according to a direction perpendicular to the direction for supplying said articles 11, which extends from said support surface 142 for said group of articles to be packaged 19 and which defines means for the discharge of the respective group of articles to be packaged 19 through the corresponding outlet 14*gu* from said module, or unit 14.

As illustrated, the conveyor 142"*n* is on the extension of said conveyor 142'*n* for receiving or forming said group of articles to be packaged 19.

In a particularly advantageous manner, as is clear in particular from said FIGS. 8A to 10B, said surface 141 for supporting said articles 11 in the supplying thereof and said surface 142 for supporting said group of articles to be packaged 19 are mutually coplanar.

Furthermore, said conveyor 142"*n* and said conveyor 142'*n* are also mutually coplanar.

Advantageously, as is clear in particular from said FIGS. 8A to 10B, said surface 141 for supporting said articles 11 in the supplying thereof and said surface 142 for supporting said group of articles to be packaged 19 are mutually adjacent.

In an appreciably advantageous manner, as is clear in particular from said FIGS. 8A to 9D, in accordance with the first and the second preferred implementations of said module, or unit 14 for the preparation of a respective group of articles to be packaged 19, said surface 141 for supporting said articles 11 in the supplying thereof and said surface 142 for supporting said group of articles to be packaged 19 extend mutually parallel.

In an appreciably advantageous manner, as is clear in particular from said FIGS. 10A and 10B, in accordance with the third preferred implementation of said module, or unit 14 for the preparation of a respective group of articles to be packaged 19, said surface 141 for supporting said articles 11 in the supplying thereof and said surface 142 for supporting said group of articles to be packaged 19 extend one transversally to the other one, in particular orthogonal to one another.

Advantageously, as is clear in particular from said FIGS. 8A to 10B, said module, or unit 14 for the preparation of a respective group of articles to be packaged 19 comprises means 146 for transferring said articles 11 from said surface 141 for supporting said articles 11 in the supplying thereof to said surface 142 for supporting said group of articles to be packaged 19.

With appreciable advantage, as is clear in particular from said FIGS. 8A to 10B, said module, or unit 14 for the preparation of a respective group of articles to be packaged 19 comprises means 146 for the formation of said group of articles to be packaged 19 on said surface 142 for supporting said group of articles to be packaged 19.

With appreciable advantage, as is clear in particular from said FIGS. 8A to 10B, said means 146 for transferring said articles 11 from said surface 141 for supporting said articles 11 in the supplying thereof to said surface 142 for supporting said group of articles to be packaged 19 define said means 146 for the formation of said group of articles to be packaged 19.

Advantageously, as is clear in particular from said FIGS. 8A to 10B, said means 146 for transferring said articles 11 from said surface 141 for supporting said articles 11 in the supplying thereof to said surface 142 for supporting said group of articles to be packaged 19, and/or for the formation of said group of articles to be packaged 19 on said surface 142 for supporting said group of articles to be packaged 19, are in the form of corresponding robot means 147, for example of the so-called Delta type.

With advantage, as is clear in particular from said FIGS. 8A, 8B, 10A and 10B, in accordance with the first and third preferred implementations of said module, or unit 14 for the preparation of a respective group of articles to be packaged 19, said means 146 for transferring said articles 11 and/or for the formation of said group of articles to be packaged 19 on said surface 142 for supporting said group of articles to be packaged 19, comprise a single robot 146, for example of the so-called Delta type and in particular hung at the upper side 140*e* of said supporting frame 140.

With advantage, as is clear in particular from said figures da 9A a 9D, in accordance with the second preferred implementation of said module, or unit 14 for the preparation of a respective group of articles to be packaged 19, said means 146 for transferring said articles 11 and/or for the formation of said group of articles to be packaged 19 on said surface 142 for supporting said group of articles to be packaged 19, comprise a first and a second robots 146, 146, preferably longitudinally mutually aligned, for example of the so-called Delta type, and in particular hung at the upper side 140*e* of said supporting frame 140.

Advantageously, as is clear in particular from said FIGS. 9A to 9D, said first and second robots 146, 146 are adapted to make a respective group of articles to be packaged 19, i.e., a respective first and second parts of a corresponding group of articles to be packaged 19.

In an advantageous manner, as is clear in particular from said FIGS. 8A to 10B, the respective robot 146 comprises respective movable arm means 146*b* that end in a respective head end 146*t*, to which a respective tool or clamp 146*p* for gripping and releasing said articles 11 is secured.

In an advantageous manner, as is clear in particular from said FIGS. 8A to 10B, the respective robot 146 moves, i.e., the respective tool or clamp 146*p* for gripping and releasing said articles 11 moves, between said surface 141 for supporting said articles 11 in the supplying thereof and said surface 142 for supporting said group of articles to be packaged 19, in particular moving above said surface 141 for supporting said articles 11 in the supplying thereof and said surface 142 for supporting said group of articles to be packaged 19.

Advantageously, as is clear in particular from said FIGS. 8A to 10B, said module, or unit 14 for the preparation of a respective group of articles to be packaged 19 comprises, or supports, means 1400 for detecting said articles 11 and/or said group of articles to be packaged 19, in particular for detecting the arrangement or configuration of said articles 11 and/or of said group of articles to be packaged 19 being formed, preferably to drive the movement of corresponding robot means 146 for transferring said articles 11 from said surface 141 for supporting said articles 11 in the supplying thereof to said surface 142 for supporting said group of articles to be packaged 19, and/or for the formation of said group of articles to be packaged 19 on said surface 142 for supporting said group of articles to be packaged 19.

In a particularly advantageous manner, as is clear in particular from said FIGS. 8A to 10B, said means 1400 for detecting said articles 11 and/or said group of articles to be packaged 19 are in the form of corresponding video camera means 1400.

In a particularly advantageous manner, as is clear in particular from said FIGS. 8A to 10B, said means 1400 for detecting said articles 11 and/or said group of articles to be packaged 19 are arranged above the respective surface 141 for supporting said articles 11 in the supplying thereof and/or the surface 142 for supporting said group of articles to be packaged 19 and detect corresponding articles 11, and/or the respective group of articles to be packaged 19, arranged on the respective surface 141 for supporting said articles 11 in the supplying thereof and/or on the surface 142 for supporting said group of articles to be packaged 19.

Advantageously, as is clear in particular from said FIGS. 8A to 10B, said means 1400 for detecting said articles 11, and/or said group of articles to be packaged 19, according to the flow or advancement direction, are provided upstream of the respective robot means 146 for transferring said articles 11 from said surface 141 for supporting said articles 11 in the supplying thereof to said surface 142 for supporting said group of articles to be packaged 19, and/or for the formation of said group of articles to be packaged 19 on said surface 142 for supporting said group of articles to be packaged 19.

In an appreciably advantageous manner, as is clear in particular from said FIGS. 8A, 8B, 10A and 10B, in accordance with the first and third preferred implementations of said module, or unit 14 for the preparation of a respective group of articles to be packaged 19, single detecting means, or a single detecting video camera 1400 are provided, or is provided, in inlet to said module, or unit 14 for the preparation of a respective group of articles to be packaged 19, at the respective surface 141 for supporting said articles 11 in the supplying thereof or conveyor 141*n* for the advancement of said articles 11.

In an appreciably advantageous manner, as is clear in particular from said figures from 9A to 9D, in accordance with the second preferred implementation of said module, or unit 14 for the preparation of a respective group of articles to be packaged 19, first detecting means, or video camera 1400 are provided, or is provided, in inlet to said module, or unit 14 for the preparation of a respective group of articles to be packaged 19, at the respective surface 141 for supporting said articles 11 in the supplying thereof or conveyor 141*n* for the advancement of said articles 11, upstream of first means 146 for transferring said articles 11 from said first plane 142 to said second plane 143, and/or for the formation of said group of articles to be packaged 19 on said surface 142 for supporting said group of articles to be packaged 19.

Furthermore, in an appreciably advantageous manner, as is clear in particular from said figures from 9A to 9D, in accordance with the second preferred implementation of said module, or unit 14 for the preparation of a respective group of articles to be packaged 19, second detecting means, or video camera 1400 are provided, or is provided, in an intermediate position of the respective surface 141 for supporting said articles 11 in the supplying thereof or the conveyor 141*n* for the advancement of said articles 11, upstream of second means 146 for transferring said articles 11 from said first plane 142 to said second plane 143, and/or for the formation of said group of articles to be packaged 19 on said surface 142 for supporting said group of articles to be packaged 19.

Furthermore, in an appreciably advantageous manner, as is clear in particular from said figures from 9A to 9D, in accordance with the second preferred implementation of said module, or unit 14 for the preparation of a respective group of articles to be packaged 19, third detecting means, or video camera 1400 are provided, or is provided, in an intermediate position of the respective surface 142 for supporting said group of articles to be packaged 19 or the corresponding conveyor 142*n* for the advancement of said articles 11, upstream of second means 146 for transferring said articles 11 from said first plane 142 to said second plane 143, and/or for the formation of said group of articles to be packaged 19 on said surface 142 for supporting said group of articles to be packaged 19.

However, it is understood that the present means 14, for the preparation of corresponding groups of articles, can treat, i.e., gather together, in a single common group, articles that may be the same or different from one another, for example the present means 14 can gather to define a corresponding group of articles 19 of the packets of paper rolls that are differently configurated from one another, or that are of different dimensions and forms, i.e., packets of rolls and packs of paper handkerchiefs or of paper napkins, or other different types of articles.

Figure 2E:
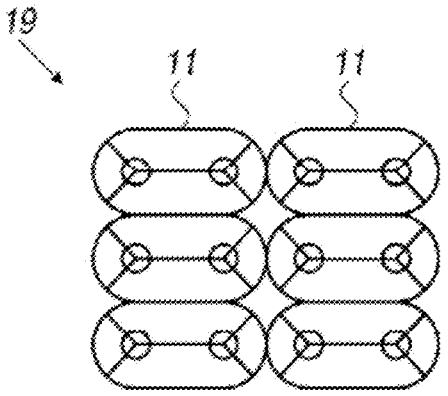
FIGS. 2E and 2F illustrate in respective schematic, top plan view respective configurations of groups of articles arranged according to the apparatus of the present invention.
Figure 2F:
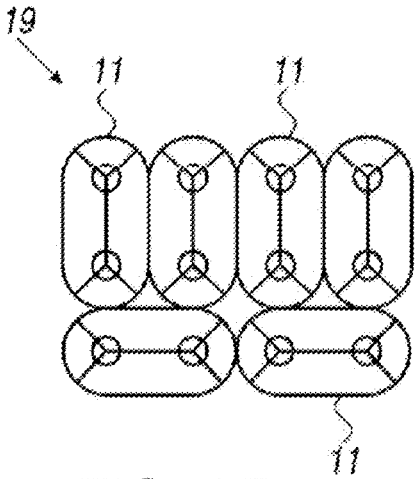

Furthermore, however, it is understood that present means 14, for the preparation of corresponding groups of articles, are adapted to arrange corresponding articles concurrently oriented, for example all oriented parallel to one another, as is clear from FIG. 2E, or in a mode that is different from one another, for example, in respective group of articles, or packets, can be arranged oriented according to a longitudinal direction and other articles or packets, can be arranged oriented according to a transversal direction, or other orientation, such as for example is clear from FIG. 2F.

Figure 11A:
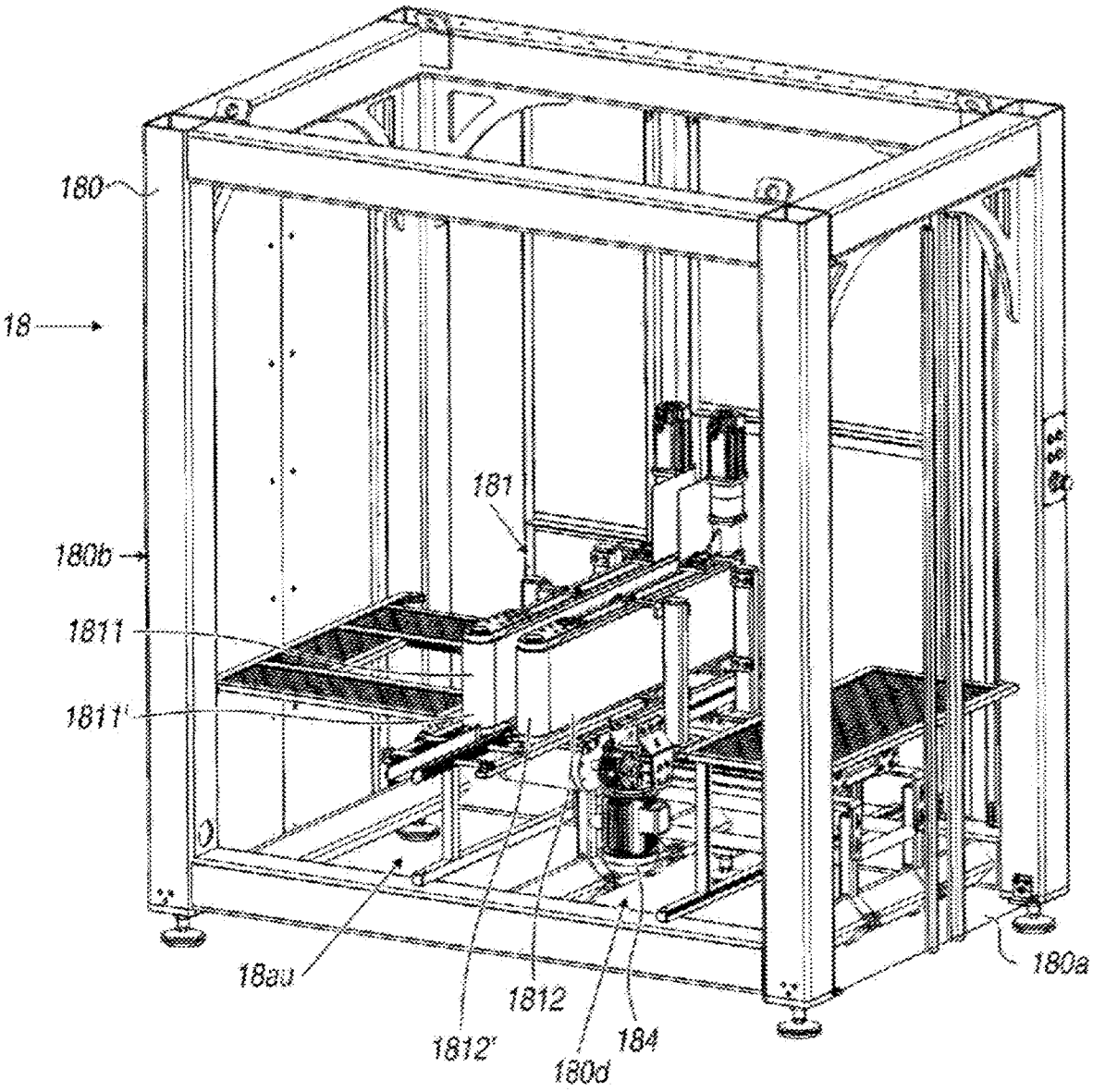
FIG. 11A illustrates a schematic, perspective view of a first preferred implementation of a module for the arrangement of the articles to be packaged being supplied, which can be used in the apparatus according to the present invention.
Figure 11B:
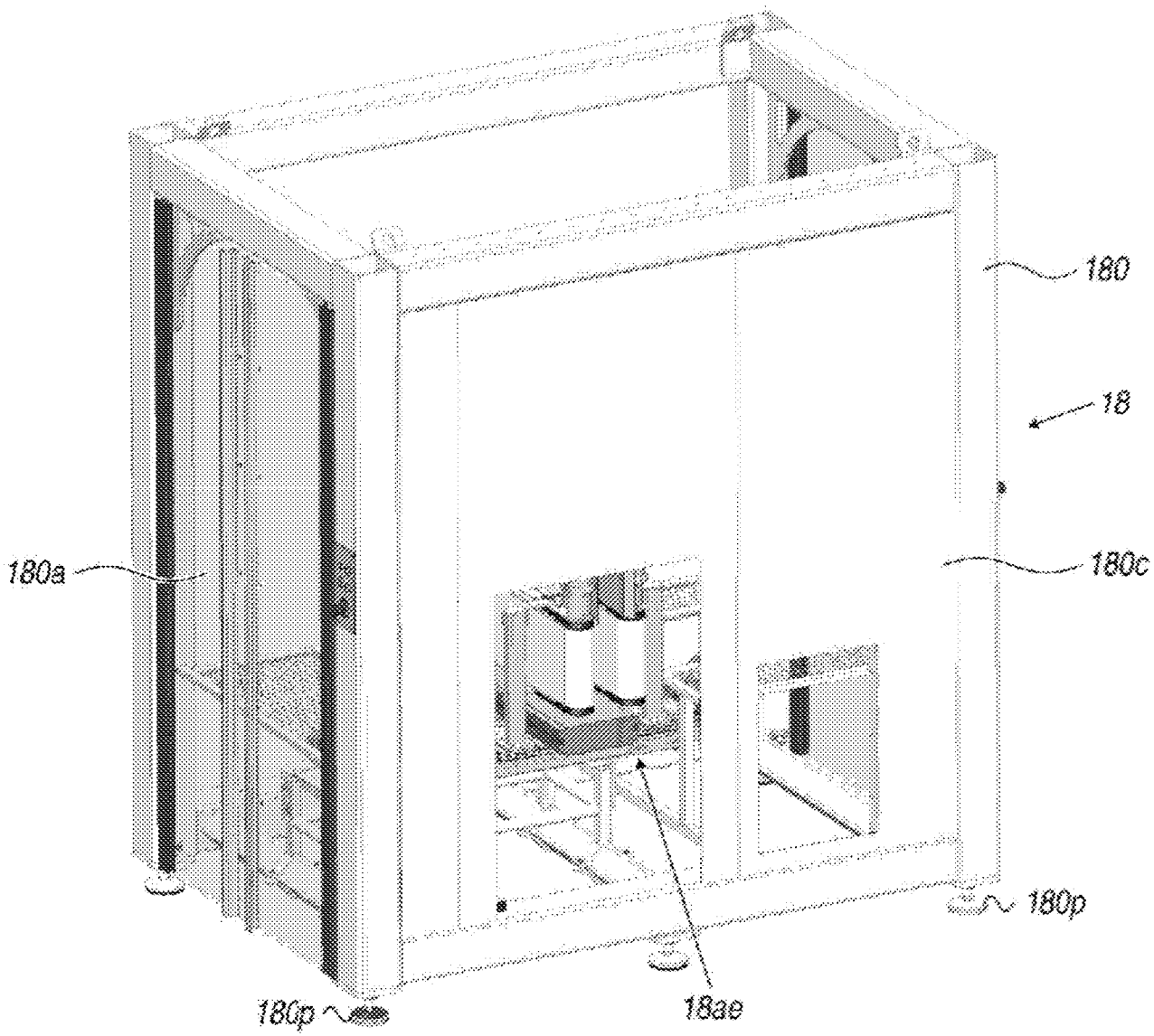
FIG. 11B illustrates a schematic, perspective view, taken from a different direction than that of FIG. 11A, of the first preferred implementation of a module for the arrangement of the articles to be packaged being supplied, which can be used in the apparatus according to the present invention.

Advantageously, as is clear in particular from FIGS. 11A and 11B, in the present apparatus, means 18 for arranging said articles 11 being supplied are provided, in particular which arranging means 18 are adapted to align, and preferably to distance, according to the supplying direction, or longitudinally, the same articles 11 in the supplying thereof.

With appreciable advantage, as is clear in particular from said FIGS. 11A and 11B, said means for arranging said articles 11 in the supplying thereof comprise a corresponding module, or unit, 18 for arranging said articles 11 in the supplying thereof.

With appreciable advantage, as is clear in particular from said FIGS. 11A and 11B, said module, or unit, 18 for arranging said articles 11 in the supplying thereof is provided upstream of the respective module, or unit, 14 for the preparation of a respective group of articles to be packaged 19, in particular longitudinally aligned thereto, especially adjacent or directly contacting it.

Advantageously, as is clear in particular from said FIGS. 11A and 11B, said module, or unit, 18 for arranging said articles 11 in the supplying thereof comprises a supporting frame 180 in particular which supporting frame 180 has a respective bearing framework, preferably comprising corresponding, especially metal, support section bars joined to one another, and is inferiorly resting on the ground through corresponding support feet 180*p*.

With advantage, as is clear in particular from said FIGS. 11A and 11B, said supporting frame 180, which is in particular in a quadrangular shape, i.e., has a quadrangular plan, is configured so as to have a front longitudinal side 180*a*, a rear longitudinal side 180*b*, a head transversal side 180*c*, especially facing, in use, a corresponding source for supplying said articles 11 arranged upstream of said apparatus 10, a tail transversal side 180*d*, especially facing, in use, a corresponding module, or unit, arranged downstream of said apparatus 10, i.e., as illustrated, towards a corresponding module, or unit, 14 for the preparation of a respective group of articles to be packaged 19.

With advantage, as is clear in particular from said FIGS. 11A and 11B, said supporting frame 180 is at least partially open on a respective side, in particular on the head transversal side 180*c*, to define the inlet 18*ae* of corresponding articles 11, and is at least partially open on a respective side, in particular on the tail transversal side 180*d* to define the outlet 18*au* of corresponding articles 11, preferably in an aligned arrangement and in particular mutually spaced apart.

As illustrated, said module, or unit, 18 for arranging said articles 11 said longitudinal, respectively front and rear, sides 180*a*, 180*b* are closed by corresponding, preferably transparent, panels, and which can be preferably open to allow the access, for the maintenance or reactivation, inside the same module, or unit, 18.

Advantageously, as is clear in particular from said FIGS. 11A and 11B, said module, or unit, 18 for arranging said articles 11 in the supplying thereof comprises means 181 for advancing the respective article 11.

In an advantageous manner, as is clear in particular from said FIGS. 11A and 11B, said means 181 for advancing the respective article 11 are adapted to define a row of said articles 11, longitudinally mutually spaced apart, or a plurality of rows of these articles 11, longitudinally mutually spaced apart, and in particular a plurality of parallel rows of said articles 11, especially transversally mutually spaced apart.

In an advantageous manner, as is clear in particular from said FIGS. 11A and 11B, said means 181 for advancing the respective article 11 comprise un primary and secondary opposite small rotatable webs 1811, 1812, for the engagement on the opposite sides of the respective article 11 and for the advancing, in particular a longitudinal advancing, thereof.

As illustrated, a first and a second opposite small rotatable webs 1811, 1812 are elongated, in the longitudinal direction, and have the respective rotatable engagement surface, or band, that is vertically oriented.

Advantageously, as is clear in particular from said FIGS. 11A and 11B, said first and second opposite small rotatable webs 1811, 1812 for the engagement and advancing of said articles 11 have a corresponding free end 1811', 1812', that is transversally movable, i.e., are tilting with respect to a corresponding vertical axis, so as to release articles 11 in different, and preferably transversally mutually spaced apart, transversal positions, such as to create corresponding, in particular parallel, rows of said articles 11.

In a particularly advantageous manner, as is clear in particular from said FIGS. 11A and 11B, said module, or unit, 18 for arranging said articles 11 in the supplying thereof comprises means 184, in particular a conveyor belt, for the movable support of said articles 11 towards a corresponding outlet, which inferiorly support the same articles 11 and are provided below said means 181 for advancing the respective article 11, in particular said movable support means 184 have a corresponding speed for the advancement of the same articles 11 that matches with, and preferably is equal to, that of the same means 181 for advancing the respective article 11.

In this manner, the damage to said articles 11 is avoided to the greatest extent.

Figure 12A:
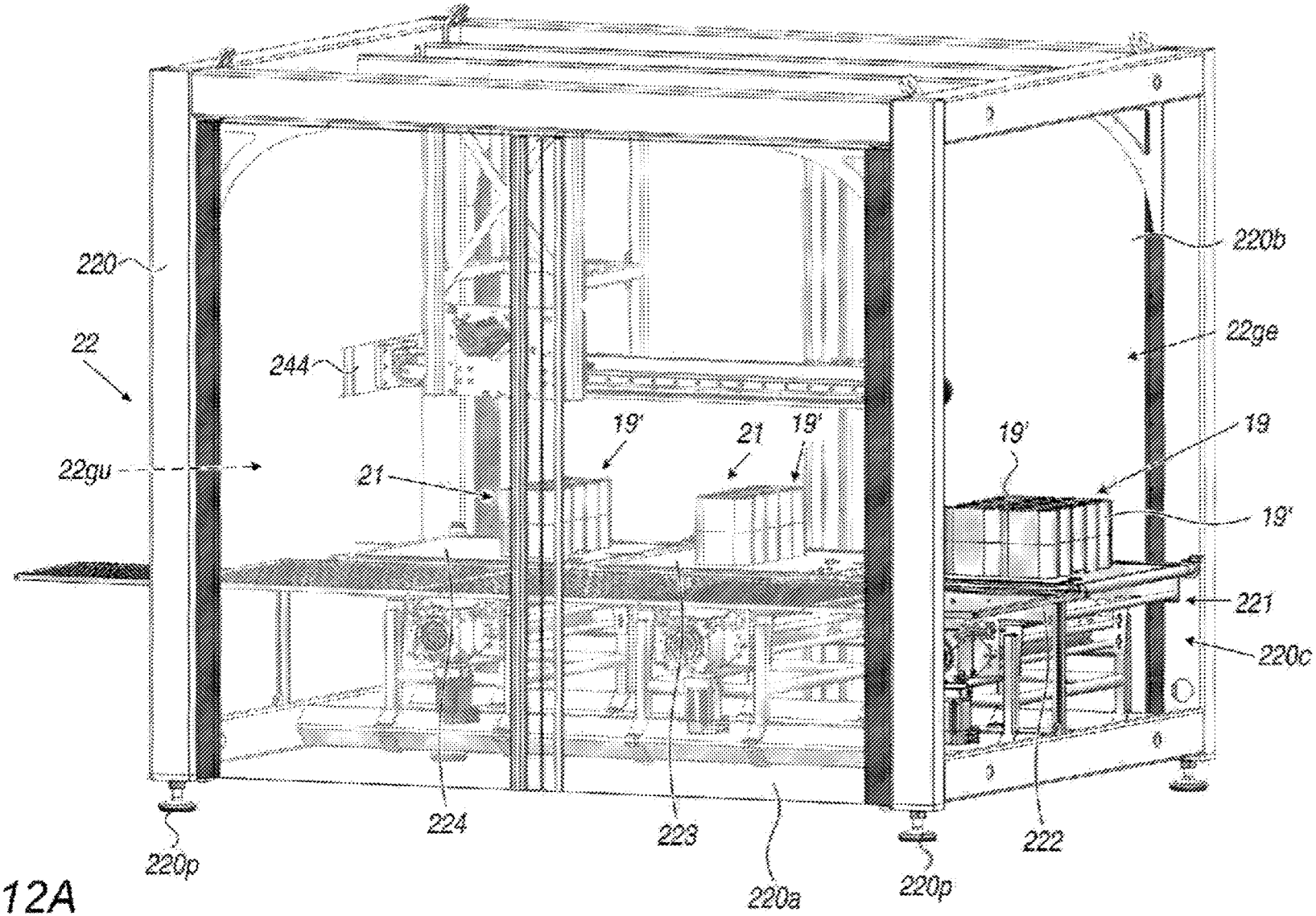
FIG. 12A illustrates a schematic, perspective view of a first preferred implementation of module for forwarding said group of articles to be packaged and/or for the separation of the group of articles to be packaged in corresponding parts of group, which can be used in the apparatus according to the present invention.
Figure 12B:
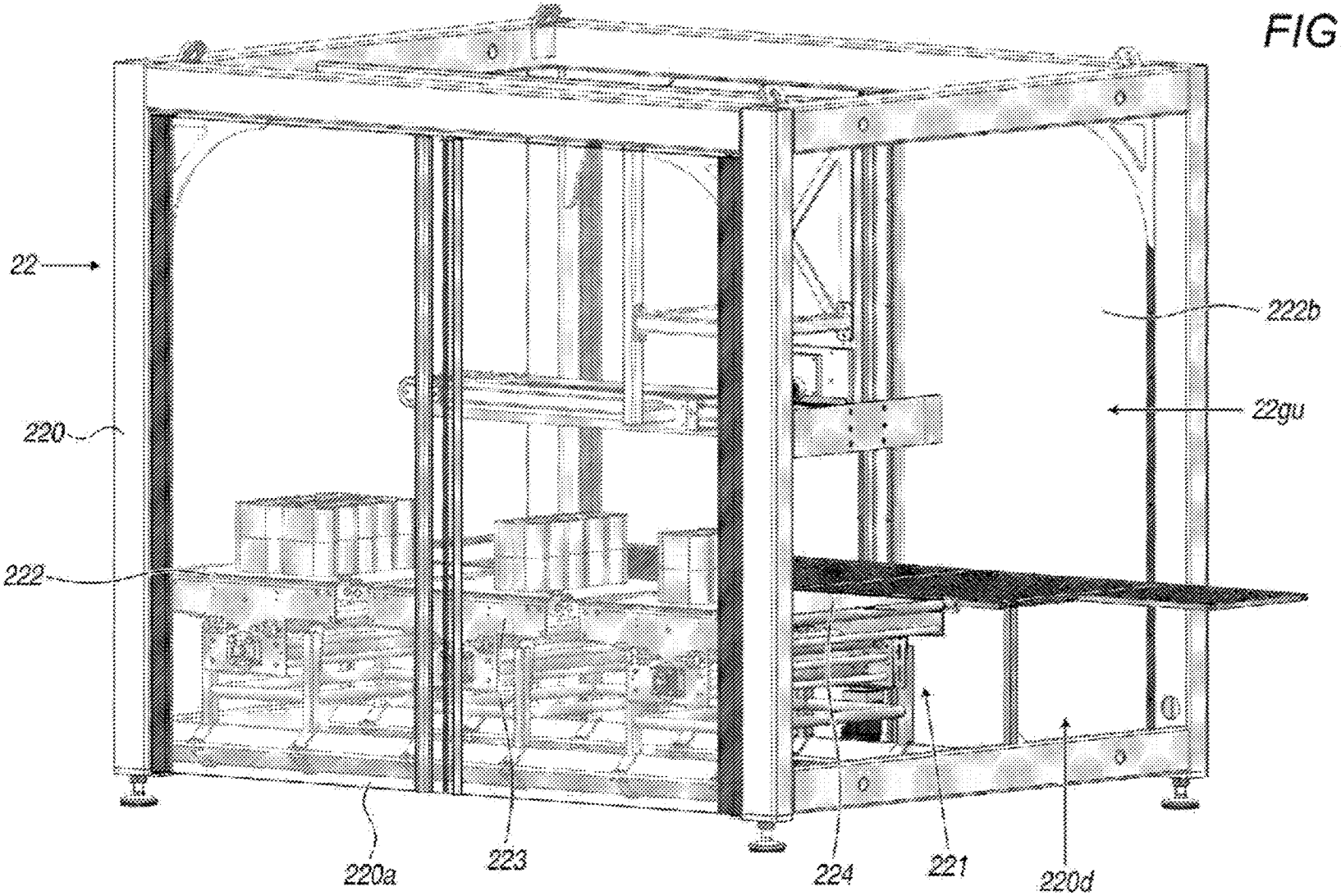
FIG. 12B illustrates a schematic, perspective view, taken from a different direction than that of FIG. 12A, of the first preferred implementation of module for forwarding said group of articles to be packaged and/or for the separation of the group of articles to be packaged in corresponding parts of group, which can be used in the apparatus according to the present invention.
Figure 12C:
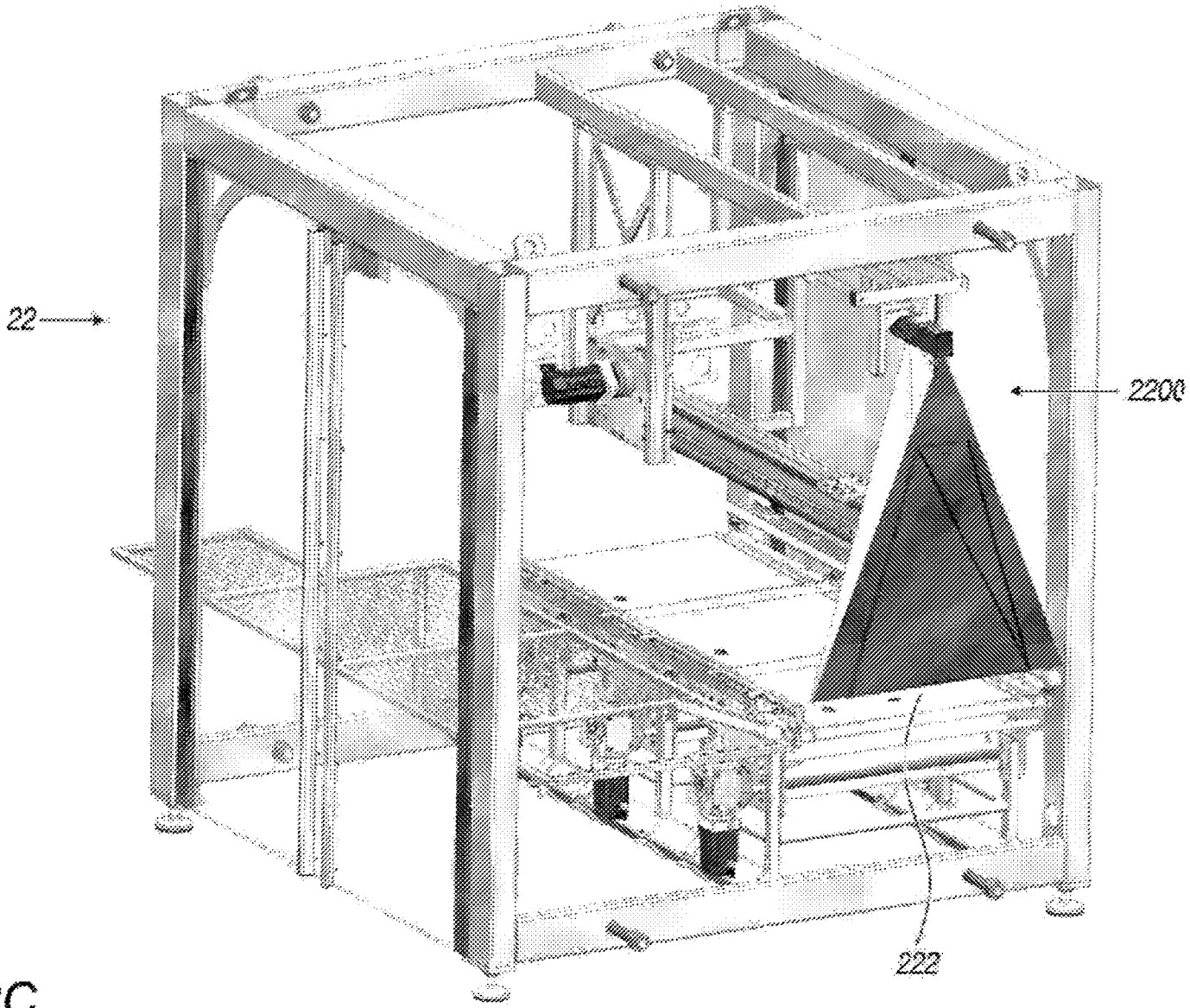
FIG. 12C illustrates a schematic, perspective view, taken from a different direction than that of FIGS. 12A and 12B, of the first preferred implementation of module for forwarding said group of articles to be packaged and/or for the separation of the group of articles to be packaged in corresponding parts of group, which can be used in the apparatus according to the present invention.

In a particularly advantageous manner, as is clear from said FIGS. 12A to 12C, means 22 are provided, for forwarding said group of articles to be packaged 19, in particular towards corresponding packaging means 20 of said group of articles 19.

In practice, according to a first and preferred operation mode, it is contemplated to directly package the respective group of articles 19 as made by said means 14 for preparing the same group of articles to be packaged 19.

Advantageously, as is clear from said FIGS. 12A to 12C, means 22 are provided, for separating said group of articles to be packaged 19 in corresponding parts 19', 19' of group, preferably in a first and a second parts of group, preferentially to make a corresponding final group of articles to be packaged, or bundle, 21, 21. In particular, said separation being carried out through a longitudinal separation or distancing of corresponding longitudinal parts 19', 19' of the same group of articles to be packaged 19.

In an appreciably advantageous manner, as is clear from said FIGS. 12A to 12C, said means 22 for forwarding said group of articles to be packaged 19, and/or for separating said group of articles to be packaged 19 in corresponding parts 19', 19' of group, are defined by a corresponding module, or unit, 22 for forwarding said group of articles to be packaged 19, and/or for separating said group of articles to be packaged 19 in corresponding parts 19', 19' of group.

In an appreciably advantageous manner, as is clear from said FIGS. 12A to 12C, said module, or unit, 22 for forwarding said group of articles to be packaged 19, and/or for separating said group of articles to be packaged 19 in corresponding parts 19', 19' of group, comprises a supporting frame 220, in particular which supporting frame 220 has a respective bearing framework, preferably comprising corresponding, preferentially metal, supporting section bars that are connected with one another, and is especially inferiorly resting on the ground through corresponding support feet 220*p*.

Advantageously, as is clear from said FIGS. 12A to 12C, said supporting frame 220 of said module, or unit, 22 for forwarding said group of articles to be packaged 19, and/or for separating said group of articles to be packaged 19 in corresponding parts 19', 19' of group, is configured so as to have a front longitudinal side 220*a*, a rear longitudinal side 220*b*, a head transversal side 220*c*, especially facing, in use, a corresponding module, or unit arranged upstream of said apparatus 10, i.e., towards said means 14 for preparing a respective group of articles to be packaged 19 or towards said module, or unit 14 for the preparation of a respective group of articles to be packaged 19, and a tail transversal side 220*d*, especially facing, in use, a corresponding module, or unit, arranged downstream of said apparatus 10, i.e., as in any case is best seen from the following of the present description, towards packaging means 20, and in particular in the form of means 24 for packaging said group of articles to be packaged 19, in particular in a corresponding envelope, especially in plastic or paper film.

With appreciable advantage, as is clear from said FIGS. 12A to 12C, said supporting frame 220 is at least partially open on a respective side, in particular on the head transversal side 220*c*, to define the inlet 22*ge* of corresponding groups of articles to be packaged 19, in particular coming from said means 14 for preparing a respective group of articles to be packaged 19 or from said module, or unit 14 for the preparation of a respective group of articles to be packaged 19, and is at least partially open on a respective side, in particular on the tail transversal side 220*d* to define the outlet 22*gu* of corresponding groups of articles to be packaged 19, and/or of corresponding parts 19', 19' of group, preferentially adapted to make a corresponding final group of articles to be packaged, or bundle, 21, 21, in particular towards packaging means 20, especially towards said means 24 for packaging said group of articles to be packaged 19, in particular in a corresponding envelope, especially in plastic or paper film.

With appreciable advantage, as is clear from said FIGS. 12A to 12C, said module, or unit, 22 for forwarding said group of articles to be packaged 19, and/or for separating said group of articles to be packaged 19 in corresponding parts 19', 19' of group, comprise means 221 for the advancement of the group of articles to be packaged 19, or of a corresponding part 19' thereof.

Advantageously, as is clear from said FIGS. 12A to 12C, said means 221 for the advancement of the group of articles to be packaged 19, or of a corresponding part 19' thereof, comprise a plurality of conveyors, preferably in a number of three conveyors, and in particular in the form of corresponding conveyor belts, 222, 223, 224, for the advancement of the group of articles to be packaged 19, or of a corresponding part 19' thereof, which conveyors, or conveyor belts, 222, 223, 224 are one next to the other, in particular longitudinally mutually aligned, to move forward, in particular longitudinally, the same group of articles to be packaged 19, or a corresponding part 19' thereof.

As is clear from said FIGS. 12A to 12C, advantageously, said means 221 for the advancement of the group of articles to be packaged 19, or of a corresponding part 19' thereof comprise one, in particular a first advancing conveyor, or conveyor belt 222, il quale is arranged upstream, in particular at said inlet 22*ge* for said group of articles to be packaged 19 of said module, or unit, 22 for forwarding said group of articles to be packaged 19, and/or for separating said group of articles to be packaged 19 in corresponding parts 19', 19' of group.

Said, in particular first upstream-arranged advancing conveyor, or conveyor belt 222 is adapted to receive and support said group of articles to be packaged 19, preferably received by said means 14 for preparing a respective group of articles to be packaged 19, i.e., by said module, or unit 14 for the preparation of a respective group of articles to be packaged 19.

With advantage, as is clear from said FIGS. 12A to 12C, said means 221 for the advancement of the group of articles to be packaged 19, or of a corresponding part 19' thereof comprise a second advancing conveyor, or conveyor belt 223, said second conveyor, or conveyor belt, 223 is arranged downstream of said first conveyor or conveyor belt 222 and adapted to move forward and support a group of articles to be packaged 19, or, when it works to separate or divide said group of articles to be packaged 19, a corresponding part 19' of the same group of articles to be packaged 19. In particular, to this aim, operatively, after the first and the second conveyors 222 and 223, have advanced together the corresponding group of articles, until a part 19' thereof is supported by the second conveyor 223, while the remaining part of the same group 19 remains on the first conveyor 222, it will be only required to stop the first conveyor and let the second conveyor 223 advance, so as to distance, in order to separate, a longitudinal part 19' of the group of articles 19 from the remaining part thereof.

Advantageously, as is clear from said FIGS. 12A to 12C, said means 221 for the advancement of the group of articles to be packaged 19, or of a corresponding part 19' thereof, comprise one, in particular a third, advancing conveyor, or conveyor belt 224, arranged downstream, in particular of said second conveyor, or conveyor belt, 223.

Said in particular third conveyor, or conveyor belt, 224 is adapted to move forward and support a group of articles to be packaged 19, or a corresponding part 19' of the same group of articles to be packaged 19, and especially extends at the outlet 22*gu* from said module, or unit 22 for forwarding said group of articles to be packaged 19, and/or for separating said group of articles to be packaged 19 in corresponding parts 19', 19' of group, so as to allow said group of articles to be packaged 19, or a corresponding part 19' thereof to exit.

As is clear from said FIGS. 12A to 12C, advantageously, said module, or unit, 22 for forwarding said group of articles to be packaged 19, and/or for separating said group of articles to be packaged 19 in corresponding parts 19', 19' of group, is provided for downstream of said module, or unit 14 for the preparation of a respective group of articles to be packaged 19, in particular longitudinally aligned thereto, especially adjacent or directly contacting it.

In an advantageous manner, as is clear from said FIGS. 12A to 12C, said first advancing conveyor, or conveyor belt 222, said second advancing conveyor, or conveyor belt 223 and/or said third advancing conveyor, or conveyor belt 224, of said means 221 for the advancement of the group of articles to be packaged 19, or of a corresponding part 19' thereof, are mutually coplanar.

Figure 12D:
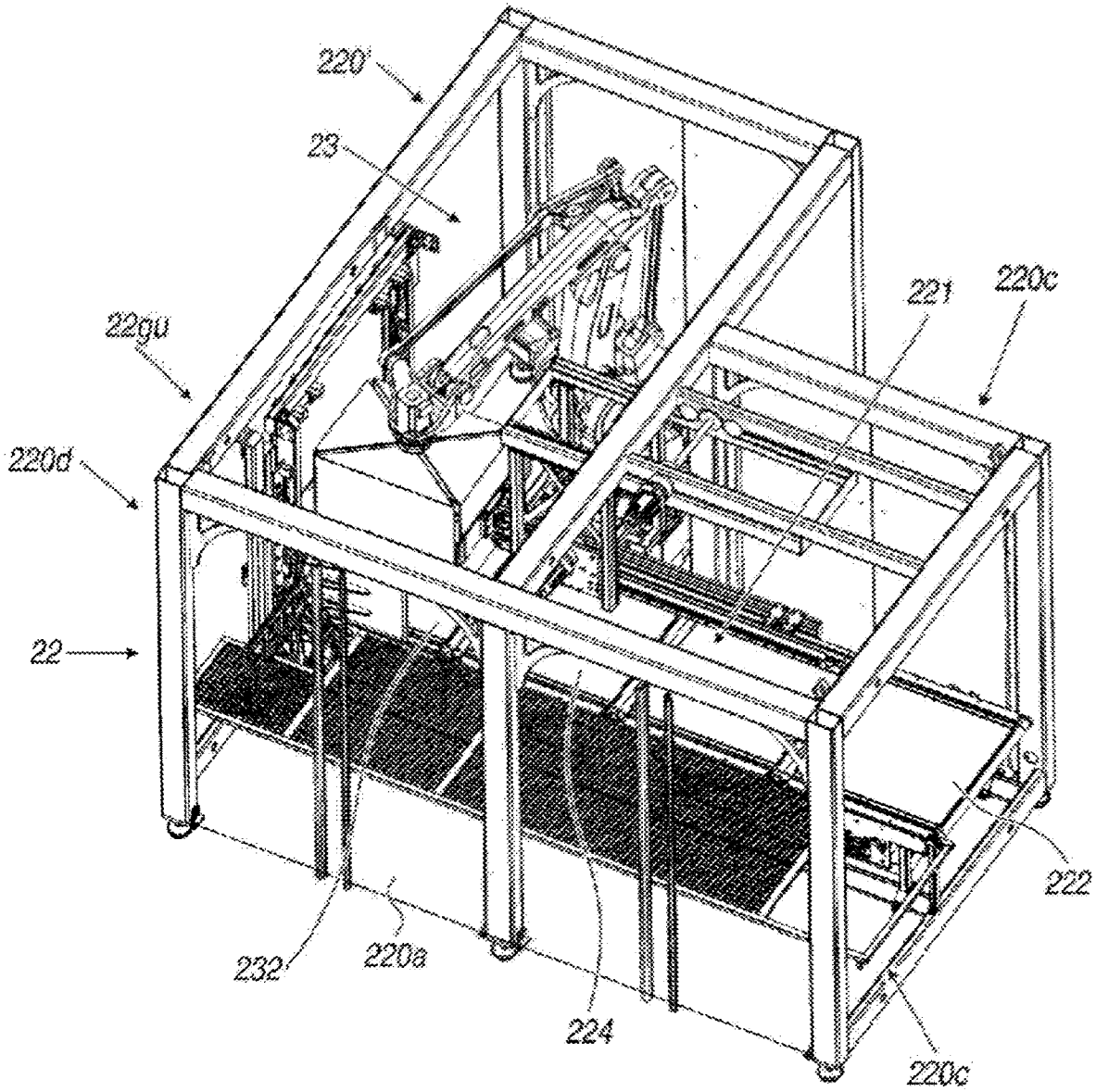
FIG. 12D illustrates a schematic, perspective view of a second preferred implementation of module for forwarding said group of articles to be packaged and/or for the separation of the group of articles to be packaged in corresponding parts of group, which can be used in the apparatus according to the present invention.

Advantageously, as is clear from the subsequent FIG. 12D, illustrating a second version of said means or module 22, overlapping, or stacking means 23 are provided, of corresponding groups of articles to be packaged 19, or of corresponding parts 19', 19' of group, preferentially to make a corresponding final group of articles to be packaged, or bundle, 21, in particular said overlapping taking place by positioning a layer of articles 11, defined by a corresponding group of articles to be packaged 19, or a corresponding part 19' of group, superiorly to another layer of articles 11 defined by a corresponding group of articles to be packaged 19, or by a corresponding part 19' of group.

As is clear from said FIG. 12D, advantageously, in accordance with the second version of said means or module 22, said overlapping, or stacking means 23 of corresponding groups of articles to be packaged 19, or of corresponding parts 19', 19' of group, preferentially to make a corresponding final group of articles to be packaged, or bundle, 21, are provided within said module, or unit, 22 for forwarding said group of articles to be packaged 19, and/or for separating said group of articles to be packaged 19 in corresponding parts 19', 19' of group.

In a particularly advantageous manner, as is clear from said FIG. 12D, in accordance with the second version of said means or module 22, said overlapping, or stacking means 23 of corresponding groups of articles to be packaged 19, or of corresponding parts 19', 19' of group, preferentially to make a corresponding final group of articles to be packaged, or bundle, 21, are in the form of corresponding robot means 23, which are adapted to grasp the respective group of articles to be packaged 19, or a corresponding part 19' thereof, and to arrange it on a corresponding group of articles to be packaged 19, or a corresponding part 19' thereof.

Advantageously, as is clear from said FIG. 12D, in accordance with the second version of said means or module 22, said robot means 23 are adapted to pick said group of articles to be packaged 19, or a corresponding part 19' thereof up from said means 221 for the advancement of the group of articles to be packaged 19, or of a corresponding part 19' thereof, in particular from said, in particular third, advancing conveyor, or conveyor belt downstream 224, and to place them on a group of articles to be packaged 19, or on a corresponding part 19' thereof, supported on a corresponding supporting surface of the stack 232.

As it is clear, advantageously, said surface 232 for supporting said stack of groups of articles to be packaged 19, or of corresponding parts 19' thereof, is arranged downstream, i.e., longitudinally downstream of said means 221 for the advancement of the group of articles to be packaged 19, or of a corresponding part 19' thereof, in particular immediately downstream of, and coplanar to, said, in particular third, advancing conveyor, or conveyor belt downstream 224, and/or which said supporting surface 232 of the stack of groups of articles to be packaged 19, or of corresponding parts 19' thereof, is especially provided for at the outlet 22*gu* for said group of articles to be packaged 19, or for a corresponding part 19' thereof, i.e., for said final group of articles to be packaged, or bundle, 21.

As is clear from said FIG. 12D, advantageously, in accordance with the second version of said means or module 22, said robot means 23 are arranged in a corresponding laterally protruding part 220' of said supporting frame 220 of said module, or unit, 22 for forwarding said group of articles to be packaged 19, and/or for separating said group of articles to be packaged 19 in corresponding parts 19', 19' of group, in particular protruding with respect to the rear longitudinal side 220*c* of the same supporting frame 220.

In an appreciably advantageous manner, as is clear from the subsequent FIG. 12D, illustrating a second version of said means or module 22, said robot means 23 are located laterally to said supporting surface 232, and/or are in the form of a corresponding anthropomorphic robot, or possibly of the Cartesian type, and/or comprise respective movable arm means 23*b* that end in a respective head end 23*t*, to which a respective tool or clamp 23*p* for gripping and releasing said group of articles to be packaged 19, or a corresponding part 19' thereof is secured, and preferably is further resting to the ground, and which however can be hung or secured superiorly to the frame of the module and such as to extend downwardly.

As is clear from FIG. 12D, said arm 23*b* of said anthropomorphic robot 23 moves between the upper surface that supports the group of articles, or corresponding part thereof, of the conveyor 224, and said surface 232 that supports the stack.

Advantageously, as is clear from said FIG. 12C, said module, or unit, 22 for forwarding said group of articles to be packaged 19, and/or for separating said group of articles to be packaged 19 in corresponding parts 19', 19' of group, comprises, or supports, means 2200 for detecting said group of articles to be packaged 19, in particular for the control thereof, i.e., for detecting the arrangement or configuration of said group of articles to be packaged 19.

As is clear from said FIG. 12C, advantageously, said means 2200 for detecting said group of articles to be packaged 19 are in the form of a laser profilometer 2200. However, it is understood that also other detecting devices or means can be used instead of said profilometer.

With appreciable advantage, as is clear from said FIG. 12C, said means 2200 for detecting said group of articles to be packaged 19, or a corresponding part 19' thereof, are arranged above the respective surface for supporting said group of articles to be packaged 19 of said first conveyor, or conveyor belt 222 receiving said means 221 for the advancement of the group of articles to be packaged 19 of said module, or unit, 22 for forwarding said group of articles to be packaged 19, and/or for separating said group of articles to be packaged 19 in corresponding parts 19', 19' of group, and detect the respective group of articles to be packaged 19 arranged on the same upper support surface 222 thereof.

Advantageously, as is clear from said FIGS. 13A to 15B, said means 24 are provided for packaging said group of articles to be packaged 19, or a corresponding part 19' thereof, i.e., said final group of articles to be packaged, or bundle, 21, in particular in a corresponding envelope, especially in plastic or paper film, preferably to make a corresponding bag that holds these articles 11.

As is clear from said FIGS. 13A to 15B, advantageously, said means 24 for packaging said group of articles to be packaged 19, or a corresponding part 19' thereof, i.e., said final group of articles to be packaged, or bundle, 21, are in the form of a corresponding module, or unit, 24 adapted to package said group of articles to be packaged 19, or a corresponding part 19' thereof, i.e., said final group of articles to be packaged, or bundle, 21, in particular in a corresponding envelope, preferably to make a corresponding bag that holds these articles 11.

With advantage, as is clear from said FIGS. 13A to 15B, said module, or unit, 24 adapted to package said group of articles to be packaged 19, or a corresponding part 19' thereof, i.e., said final group of articles to be packaged, or bundle, 21, in particular in a corresponding envelope, preferably to make a corresponding bag that holds these articles 11, comprises a supporting frame 240 in particular which supporting frame 240 has a respective bearing framework, preferably comprising corresponding, preferentially metal, supporting section bars, in particular connected with one another, and is inferiorly resting on the ground through corresponding support feet 240*p*.

Advantageously, as is clear from said FIGS. 13A to 15B, said supporting frame 240, of said packaging module, or unit, in particular in a corresponding envelope 24, is configured, preferably having a general quadrangular shape in plan, so as to have a front longitudinal side 240*a*, a rear longitudinal side 240*b*, a head transversal side 240*c*, especially facing, in use, a corresponding module, or unit arranged upstream of said apparatus 10, preferably in the form of said module, or unit, 22 for forwarding said group of articles to be packaged 19, and/or for separating said group of articles to be packaged 19 in corresponding parts 19', 19' of group, and a tail transversal side 240*d*, especially facing, in use, a corresponding module, or unit, arranged downstream of said apparatus 10, in particular in the form of corresponding palletization means 28, as in any case is best seen from the following of the present description.

As is clear from said FIGS. 13A to 15B, advantageously, said supporting frame 240 is at least partially open on a respective side, in particular on the head transversal side 240*c*, to define the inlet 24*ge* of said corresponding group of articles to be packaged 19, or of a corresponding part 19' thereof, i.e., of said final group of articles to be packaged, or bundle, 21, and is at least partially open on a respective side, in particular on the tail transversal side 240*d* to define the outlet 24*gu* of a corresponding package, in particular of a corresponding bag 13' that holds said articles 11.

As is clear, said longitudinal, respectively front and rear, sides 240*a*, 240*b* are closed by corresponding panels, preferably transparent, and preferably that can be opened to allow the access inside the same module, or unit, 24.

As is clear, said packaging module, or unit, in particular in a corresponding envelope 24 is provided downstream of the respective module, or unit, 22 module, or unit, 22 for forwarding said group of articles to be packaged 19, and/or for separating said group of articles to be packaged 19 in corresponding parts 19', 19' of group, and is especially adjacent or directly contacting it.

Figure 13A:
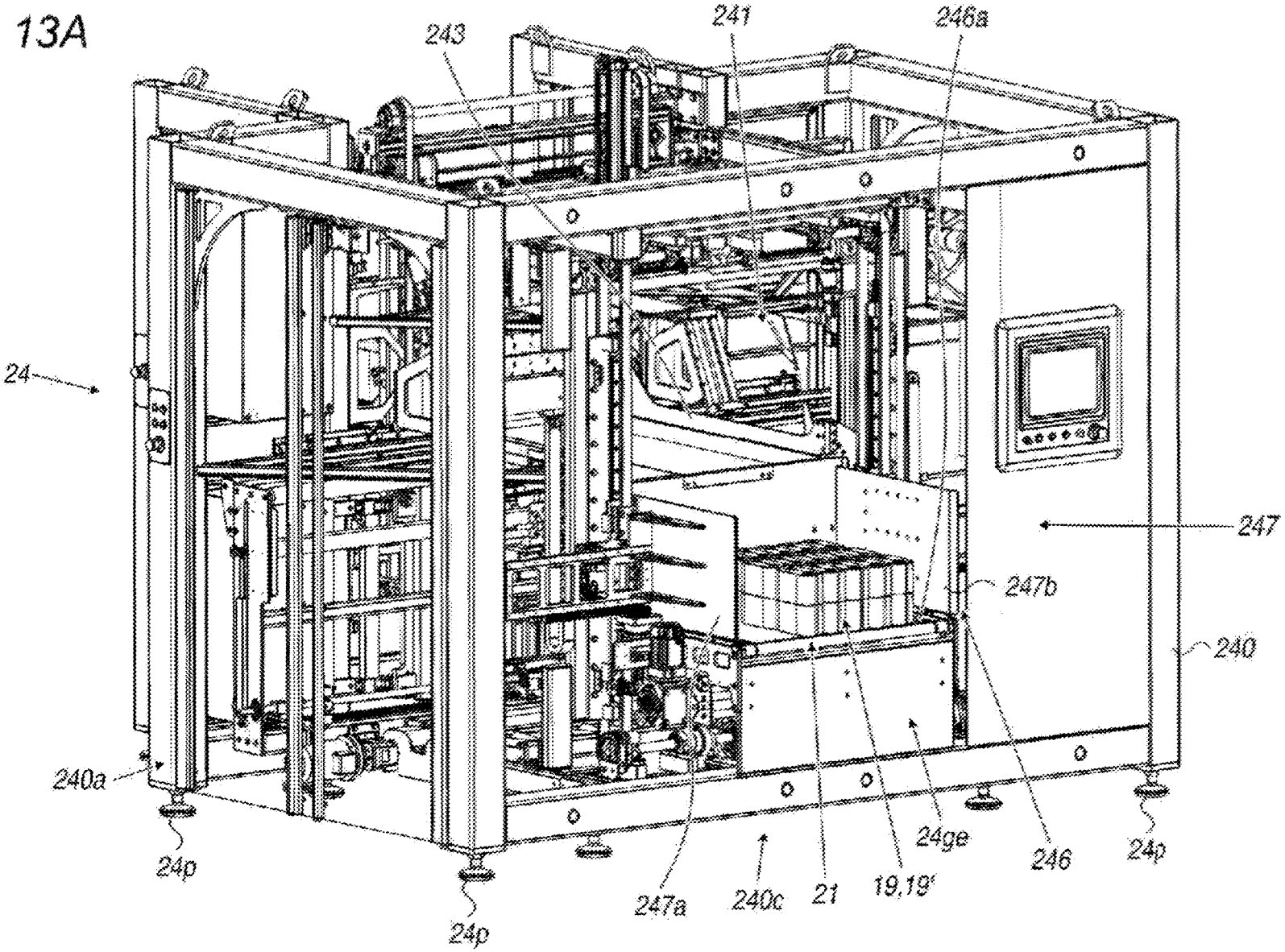
FIG. 13A illustrates a schematic, perspective view of a first preferred implementation of a module for packaging the group of articles to be packaged, in particular in a corresponding envelope, especially in plastic or paper film, in particular to define a corresponding bag, which can be used in the apparatus according to the present invention.
Figure 13B:
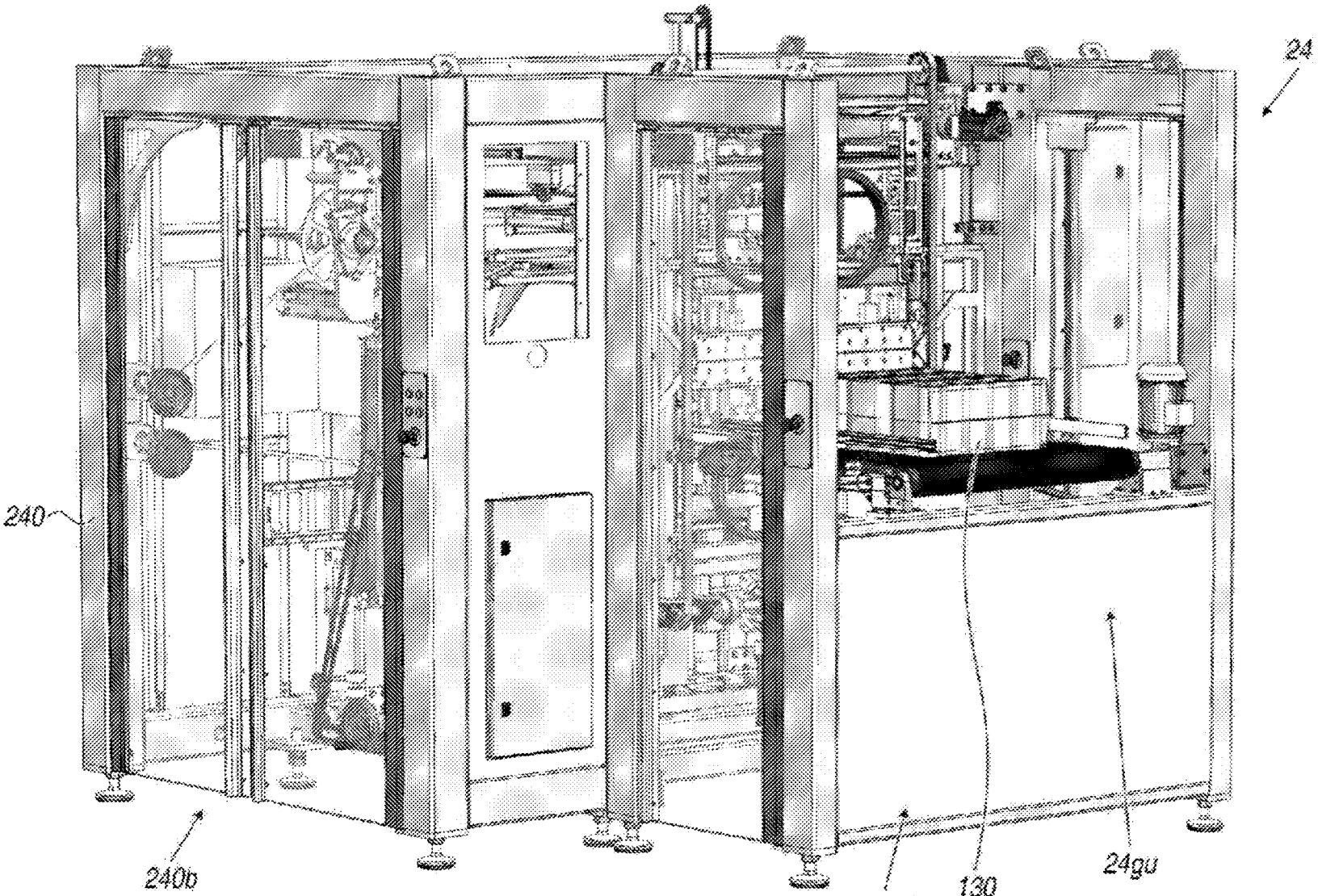
FIG. 13B illustrates a schematic, perspective view, taken from a different direction than that of FIG. 13A, of the first preferred implementation of a module for packaging the group of articles to be packaged, in particular in a corresponding envelope, especially in plastic or paper film, in particular to define a corresponding bag, which can be used in the apparatus according to the present invention.

In an advantageous manner, as is clear from said FIGS. 13A to 15B, said packaging module, or unit, in particular in a corresponding envelope 24, comprises means 241 for wrapping said group of articles to be packaged 19, or a corresponding part 19' thereof, i.e., said final group of articles to be packaged, or bundle, 21, with a corresponding envelope 130 in plastic film, as is best illustrated in the FIGS. 13B, or in paper.

Figure 14:
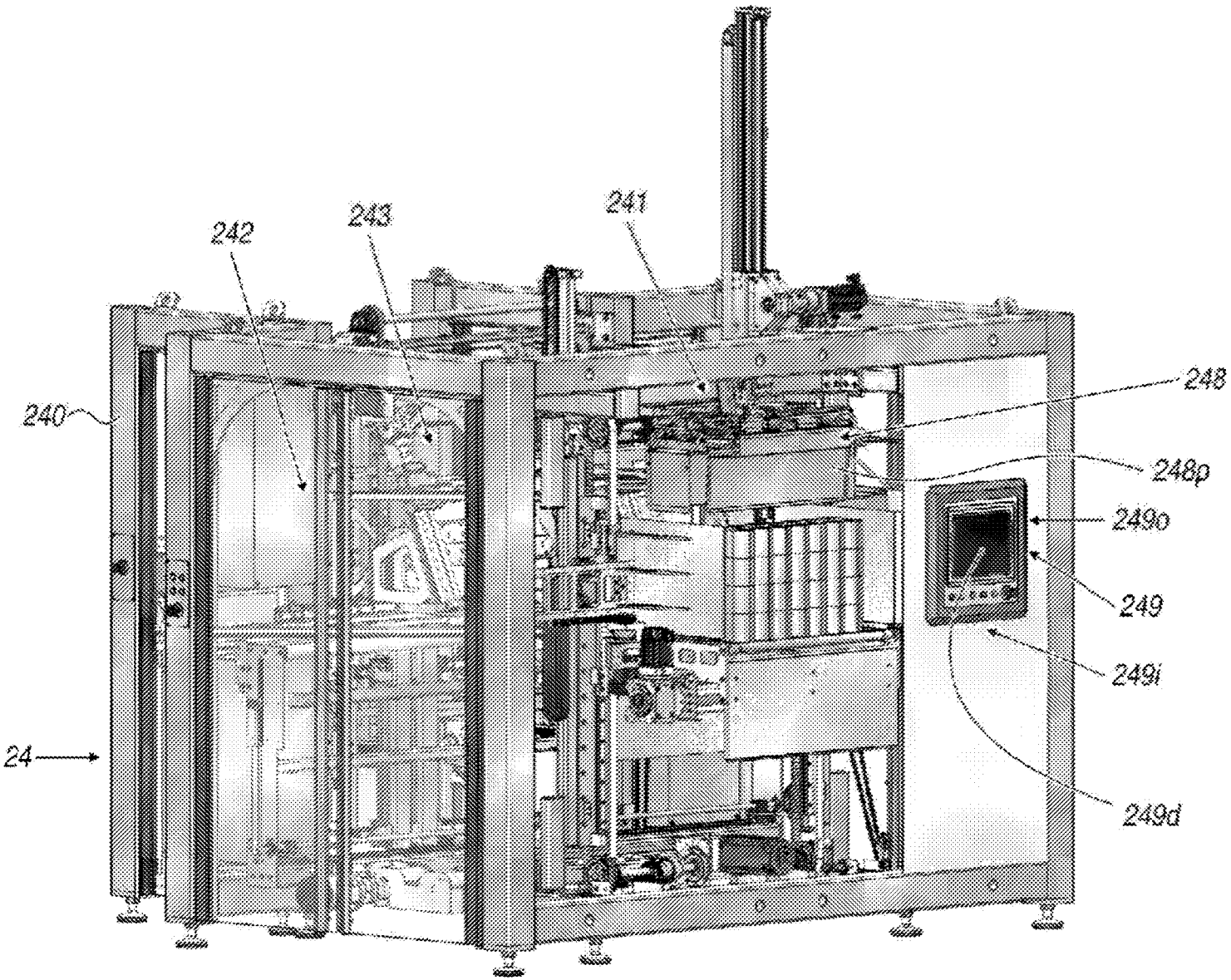
FIG. 14 illustrates a schematic, perspective view of a second preferred implementation of a module for packaging the group of articles to be packaged, in particular in a corresponding envelope, especially in plastic or paper film, in particular to define a corresponding bag, which can be used in the apparatus according to the present invention.

Advantageously, as is clear from said FIGS. 13A to 14, in accordance with a first and a second versions, said means 241 for wrapping said group of articles to be packaged 19, or a corresponding part 19' thereof, i.e., said final group of articles to be packaged, or bundle, 21, with a corresponding envelope 130 comprise means 242 for supplying a corresponding plastic or paper film.

As is clear from said FIGS. 13A to 14, advantageously, in accordance with a first and a second versions, said means 241 for wrapping said group of articles to be packaged 19, or a corresponding part 19' thereof, i.e., said final group of articles to be packaged, or bundle, 21, with a corresponding envelope 130, comprise a tunnel 243 around which said plastic or paper film is wrapped in a tubular form and inside which said group of articles to be packaged 19, or a corresponding part 19' thereof, i.e., said final group of articles to be packaged, or bundle 21 is inserted.

Figure 15A:
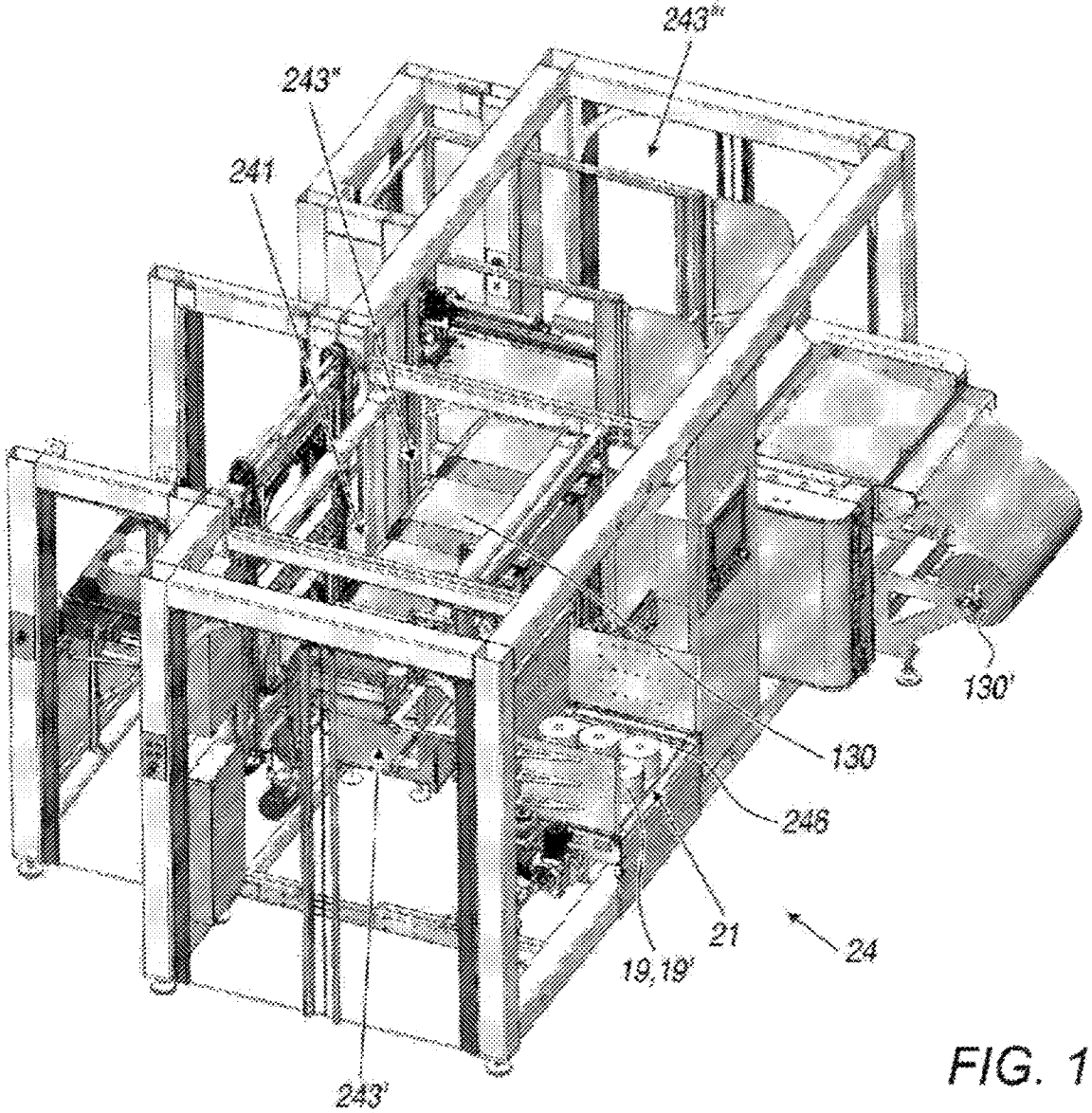
FIG. 15A illustrates a schematic, perspective view of a third preferred implementation of a module for packaging the group of articles to be packaged, in particular in a corresponding envelope, especially in plastic or paper film, in particular to define a corresponding envelope to be bagged, which can be used in the apparatus according to the present invention.
Figure 15B:
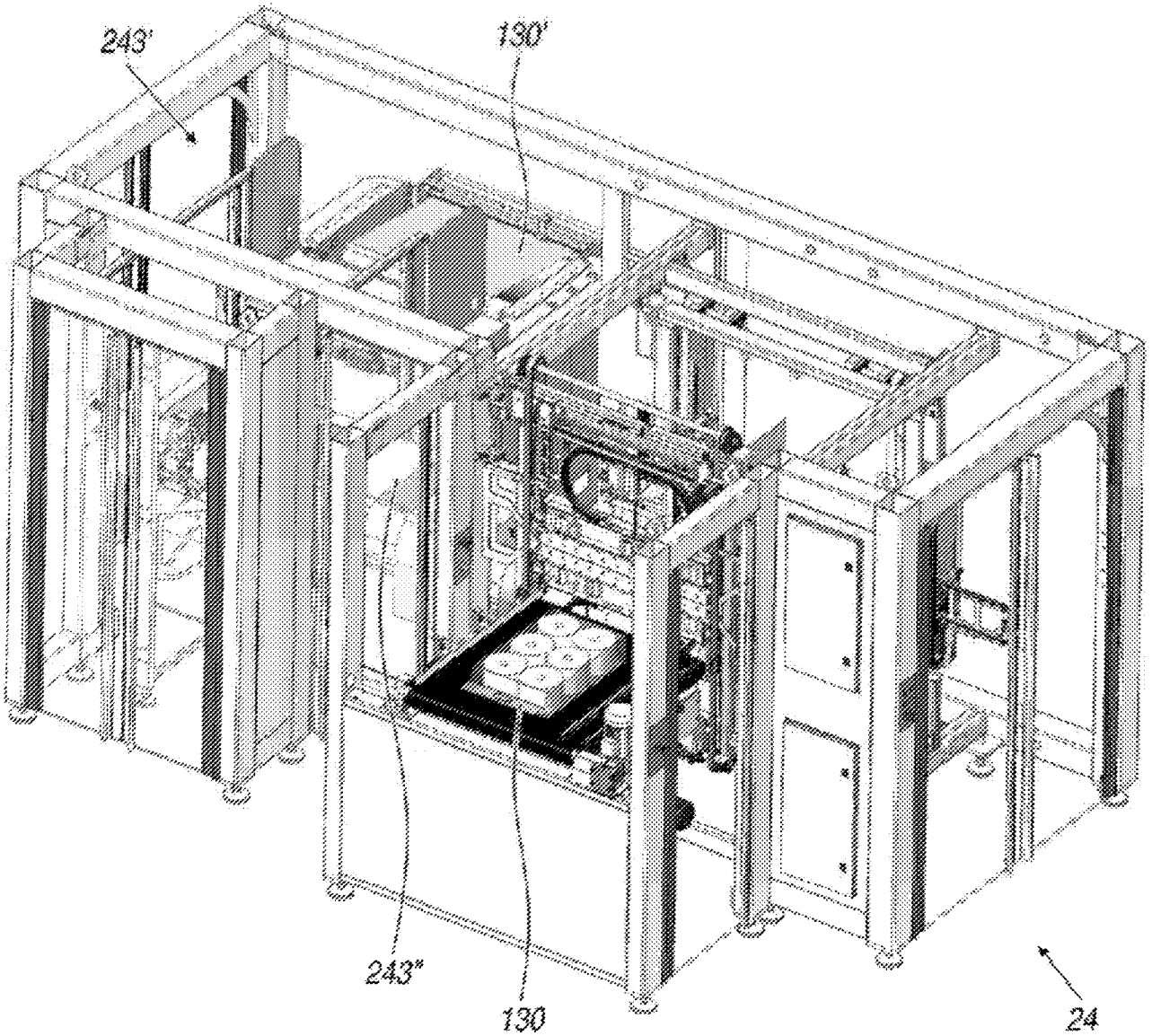
FIG. 15B illustrates a schematic, perspective view, taken from a different direction than that of FIG. 15A, of the third preferred implementation of a module for packaging the group of articles to be packaged, in particular in a corresponding envelope, especially in plastic or paper film, in particular to define a corresponding envelope to be bagged, which can be used in the apparatus according to the present invention.

In a particularly advantageous manner, as is clear from said FIGS. 15A and 15B, in accordance with a third version, said means 241 for wrapping said group of articles to be packaged 19, or a corresponding part 19' thereof, i.e., said final group of articles to be packaged, or bundle, 21, with a corresponding envelope 130 comprise means 243' for opening an envelope 130, obtained earlier, made of a plastic or paper film, defining said envelope. These means for opening the envelope can be for example made as described in the international application WO2019130200 owned by the same Applicant, and the contents of which, via the present reference, has to be intended as an integral part of the present description.

Advantageously, as is clear from said FIGS. 15A and 15B, in accordance with a third version, said module, or unit, 24 adapted to package said group of articles to be packaged 19, or a corresponding part 19' thereof, i.e., said final group of articles to be packaged, or bundle, 21, in particular in a corresponding envelope, preferably to make a corresponding bag that holds these articles 11, comprises means 243" for supplying said envelope obtained earlier 130, in particular which are provided laterally, or which extend laterally, to said wrapping means 241. These means for supplying the envelope can be made as the one described in the international application WO2019130200 owned by the same Applicant, and the contents of which, via the present reference, has to be intended as an integral part of the present description.

As is clear from said FIGS. 15A and 15B, advantageously, in accordance with a third second version, said module, or unit, 24 adapted to package said group of articles to be packaged 19, or a corresponding part 19' thereof, i.e., said final group of articles to be packaged, or bundle, 21, in particular in a corresponding envelope, preferably to make a corresponding bag that holds these articles 11, comprises means 243" for making said envelope starting from a corresponding film in plastic or paper film 130', which in particular are arranged laterally to said wrapping means 241. These means for making the envelope can be made as the one described in the international application WO2019130200 owned by the same Applicant, and the contents of which, via the present reference, has to be intended as an integral part of the present description.

In an appreciably advantageous manner, as is clear from said FIGS. 12A to 15B, means 244 are provided, for the insertion of said group of articles to be packaged 19, or of a corresponding part 19' thereof, i.e., of said final group of articles to be packaged, or bundle, 21, into said wrapping tunnel 243, and outside, i.e., downstream of, the same tunnel, such as to wrap thereupon the same tubular-shaped film, i.e., for the insertion into said previously obtained envelope 130, in an open condition, of the same group of articles to be packaged 19, or a corresponding part 19' thereof, i.e., said final group of articles to be packaged, or bundle, 21; in particular said insertion means 244 are in the form of a corresponding pusher engaging said group of articles to be packaged 19, or a corresponding part 19' thereof, i.e., said final group of articles to be packaged, or bundle, 21, and moves longitudinally to perform said insertion.

Advantageously, as is clear from said FIGS. 12A to 15B, said inserting means, or pusher 244 are carried by said module, or unit 22 for forwarding said group of articles to be packaged 19, and/or for separating said group of articles to be packaged 19 in corresponding parts 19', 19' of group, i.e., by the frame 220 thereof, in an upper position, and preferably extend longitudinally thereto.

As is clear from said FIGS. 13A to 15B, advantageously, said packaging module, or unit, in particular in a corresponding envelope 24 comprises means 245 for closing, in particular welding, said tubular film, in particular including possible means for cutting said tubular film, i.e., for closing or welding the open front side of said previously obtained envelope 130.

With appreciable advantage, as is clear from said FIGS. 13A to 15B, said packaging module, or unit, in particular in a corresponding envelope 24 comprises means 246 for the support of said group of articles to be packaged 19, or of a corresponding part 19' thereof, i.e., of said final group of articles to be packaged, or bundle, 21, in an insertion position within said tunnel 243 or envelope in an open condition 130.

Advantageously, as is clear from said FIGS. 13A to 15B, said means 246 for the support of said group of articles to be packaged 19, or of a corresponding part 19' thereof, i.e., of said final group of articles to be packaged, or bundle, 21, in an insertion position within said tunnel 243 or envelope in an open condition 130, comprise a respective resting surface 246*a* for said group of articles to be packaged 19, or for a corresponding part 19' thereof, i.e., for said final group of articles to be packaged, or bundle, 21.

As is clear from said FIGS. 13A to 15B, advantageously, said means 246 for the support of said group of articles to be packaged 19, or of a corresponding part 19' thereof, i.e., of said final group of articles to be packaged, or bundle, 21, in an insertion position within said tunnel 243 or envelope in an open condition 130, are movable between a lowered position to receive said group of articles to be packaged 19, or a corresponding part 19' thereof, i.e., said final group of articles to be packaged, or bundle, 21, and a lifted position for the insertion thereof in the corresponding tunnel 243 or envelope 130.

With advantage, as is clear from said FIGS. 13A to 15B, said packaging module, or unit, in particular in a corresponding envelope 24 comprises means 247 for centering said group of articles to be packaged 19, or a corresponding part 19' thereof, i.e., said final group of articles to be packaged, or bundle, 21, in an insertion position within said tunnel 243 or envelope in an open condition 130.

Advantageously, as is clear from said FIGS. 13A to 15B, said means 247 for centering said group of articles to be packaged 19, or a corresponding part 19' thereof, i.e., said final group of articles to be packaged, or bundle, 21, in an insertion position within said tunnel 243 or envelope in an open condition 130, comprise a first and a second opposite side walls 247*a*, 247*b* at least at least one of which being movable, i.e., both being movable, transversally to laterally engage said group of articles to be packaged 19, or a corresponding part 19' thereof, i.e., said final group of articles to be packaged, or bundle, 21, such as to arrange it in a transversal position suitable for the insertion into said wrapping tunnel 243 or the corresponding envelope 130.

As is clear from said figures, advantageously, said centering side walls 247*a*, 247*b* are brought on said means 246 for the support of said group of articles to be packaged 19, or of a corresponding part 19' thereof, i.e., of said final group of articles to be packaged, or bundle, 21, in an insertion position within said tunnel 243 or envelope in an open condition 130, in particular extending perpendicularly from said resting surface 246 thereof.

In an advantageous manner, as is clear from said FIG. 14, in accordance with the second version of said packaging module, or unit, said packaging module, or unit, in particular in a corresponding envelope 130 comprises respective means 248 for overlapping, or stacking corresponding groups of articles to be packaged 19, or corresponding parts 19', 19' of group, preferentially to make a corresponding final group of articles to be packaged, or bundle, 21.

Advantageously, as is clear from said FIG. 14, in accordance with the second version, said means 248 for overlapping, or stacking corresponding groups of articles to be packaged 19, or corresponding parts 19', 19' of group, preferentially to make a corresponding final group of articles to be packaged, or bundle, 21, comprise means 248*p* for gripping said group of articles to be packaged 19, or a corresponding part 19' thereof, in particular arranged on said resting surface 246*a*, for lifting and subsequently releasing it on a corresponding group of articles to be packaged 19, or a corresponding part 19' thereof, in particular arranged, or arrived, on said resting surface 246*a*.

As is clear from said FIGS. 13A to 15B, advantageously, said packaging module, or unit, in particular in a corresponding envelope 24, comprises respective processor driving means 249 having corresponding input and output means 249*i*, 249*o*, including corresponding keys 249*i* and a corresponding display 249*o*.

Figure 16:
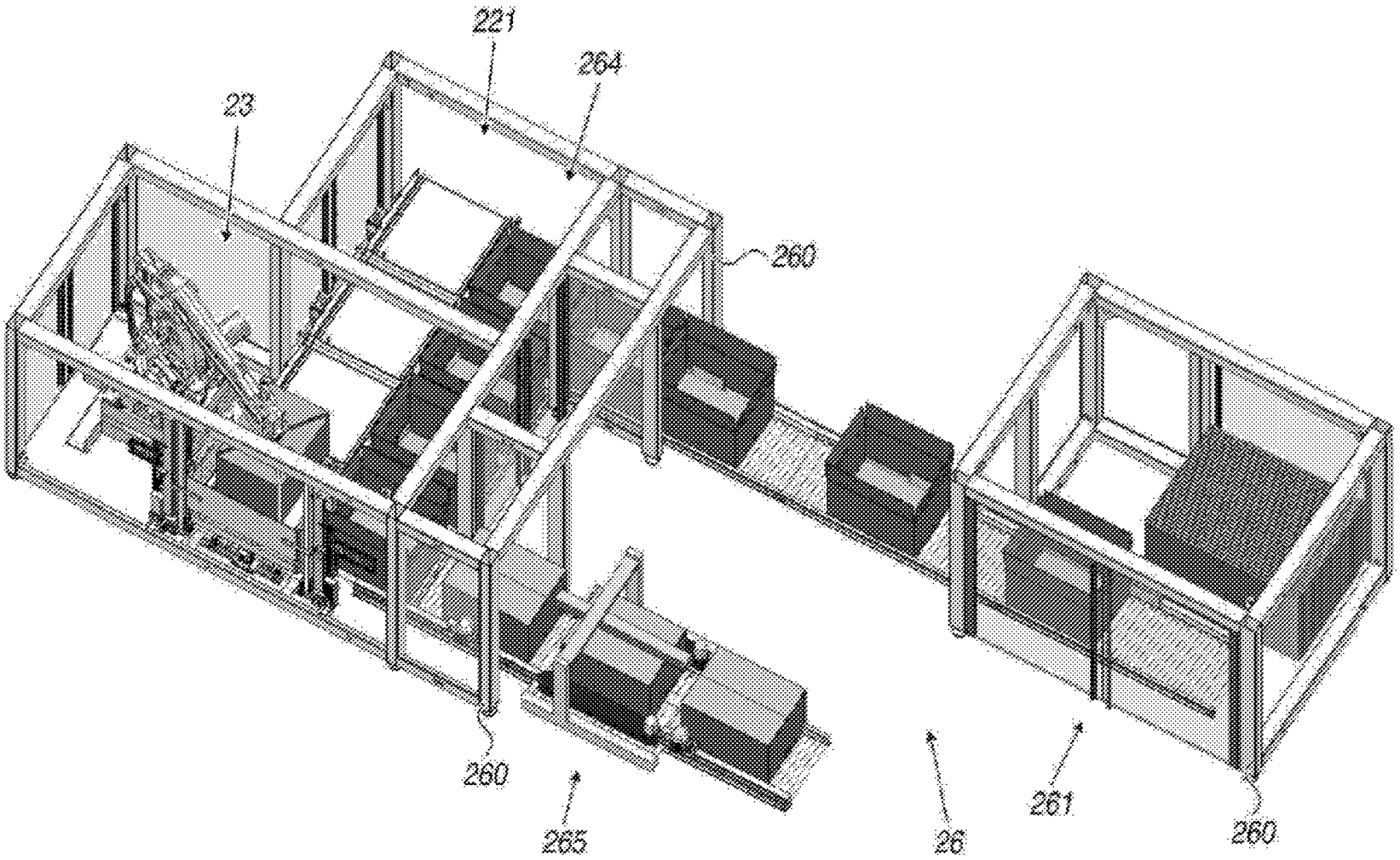
FIG. 16 illustrates a schematic, perspective view of a preferred implementation of module for boxing the group of articles to be packaged, which can be used in the apparatus according to the present invention.

In a particularly advantageous manner, as is clear from the subsequent FIG. 16, means 26 are provided for boxing said articles 11 in a respective box 13", which is in particular made of plastic material or cardboard.

Advantageously, as is clear from said FIG. 16, said means 26 for boxing said articles 11 in a respective box 13", in particular made of plastic material or cardboard, comprise a corresponding boxing module, or unit 26.

As is clear from said FIG. 16, advantageously, said boxing module, or unit 26 comprises a supporting frame 260, in particular for resting to the ground.

In an appreciably advantageous manner, as is clear from said FIG. 16, said boxing module, or unit 26 comprises means 261 defining a storage system for the blanks creating said boxes.

Advantageously, as is clear from said FIG. 16, said boxing module, or unit 26 comprises means 262 for opening said boxes, in particular at said means 261 defining a storage system.

As is clear from said FIG. 16, advantageously, said boxing module, or unit 26 comprises means 23 for the insertion of said group of articles to be packaged 19, or of a corresponding part 19' thereof, i.e., of said final group of articles to be packaged, or bundle, 21, into the respective box in an open condition.

With appreciable advantage, as is clear from said FIG. 16, said means 23 for the insertion of said group of articles to be packaged 19, or of a corresponding part 19' thereof, i.e., of said final group of articles to be packaged, or bundle, 21, into the respective box in an open condition are provided at said module, or unit, 22 for forwarding said group of articles to be packaged 19, and/or for separating said group of articles to be packaged 19 in corresponding parts 19', 19' of group.

Advantageously, as is clear from said FIG. 16, said means 23 for the insertion of said group of articles to be packaged 19, or of a corresponding part 19' thereof, i.e., of said final group of articles to be packaged, or bundle, 21, into the respective box in an open condition, comprise corresponding robot means 23, in particular in the form of an anthropomorphic robot, or possibly also of the Cartesian type.

As is clear from said FIG. 16, advantageously, said means, or robot, 23 for the insertion of said group of articles to be packaged 19, or of a corresponding part 19' thereof, i.e., of said final group of articles to be packaged, or bundle, 21, into the respective box in an open condition, define means 23 for stacking corresponding groups of articles to be packaged 19.

With advantage, as is clear from said FIG. 16, said boxing module, or unit 26 comprises conveyor means, in particular having a respective length 264 parallel to said means 221 for the advancement of the group of articles to be packaged 19, or of a corresponding part 19' thereof, into said module, or unit, 22 for forwarding said group of articles to be packaged 19, and/or for separating said group of articles to be packaged 19 in corresponding parts 19', 19' of group.

Advantageously, as is clear from said FIG. 16, said boxing module, or unit 26 comprises means 265 for closing said box containing said group of articles to be packaged 19, or a corresponding part 19' thereof, i.e., said final group of articles to be packaged, or bundle, 21.

As is clear from said FIG. 3, advantageously, means 28 are provided, for palletizing the respective package, in particular the secondary package, i.e., the respective bags or boxes, and/or for directly palletizing said group of articles to be packaged 19, or a corresponding part 19' thereof, i.e., said final group of articles to be packaged, or bundle 21.

In an advantageous manner, as is clear from said FIG. 3, said palletization means 28 are adapted to arrange on a corresponding pallet 150 a corresponding group of articles to be packaged 19, or a corresponding part 19' thereof, i.e., said final group of articles to be packaged, or bundle, 21, such as it has been prepared by said means, or module, 14 for preparing a respective group of articles to be packaged 19, and/or such as it has been prepared by said means, or module, 22 for forwarding said group of articles to be packaged 19, and/or for separating said group of articles to be packaged 19 in corresponding parts 19', 19' of group, and/or such as it has been prepared by the corresponding stacking means 23, 248.

Advantageously, as is clear from said FIG. 3, said palletization means 28 receive said group of articles to be packaged 19, or a corresponding part 19' thereof, i.e., said final group of articles to be packaged, or bundle, 21, through said packaging module, or unit 24 in a corresponding envelope, preferably to make a corresponding holding bag, said packaging module 24 operating only as a means for conveying downstream said group of articles to be packaged 19, or a corresponding part 19' thereof, i.e., said group of articles to be packaged 19.

From said FIGS. 3 to 5, it is clear as, in accordance with a first version of the first preferred implementation 10 of apparatus, it is contemplated to use for packaging groups of articles, or the corresponding parts thereof, an unit 24 for the bagging thereof, which one unit 26 for the boxing thereof, i.e., as provided in the second version of FIGS. 4A and 4B, it is contemplated to use only one bagging unit 24, i.e., as provided for in the subsequent FIG. 5, in accordance with a third version, it may be contemplated to use only one boxing unit 26. All of this to the purpose of satisfy, without the need of carrying out structural upheavals, every specific need of the respective user.

Figure 6C:
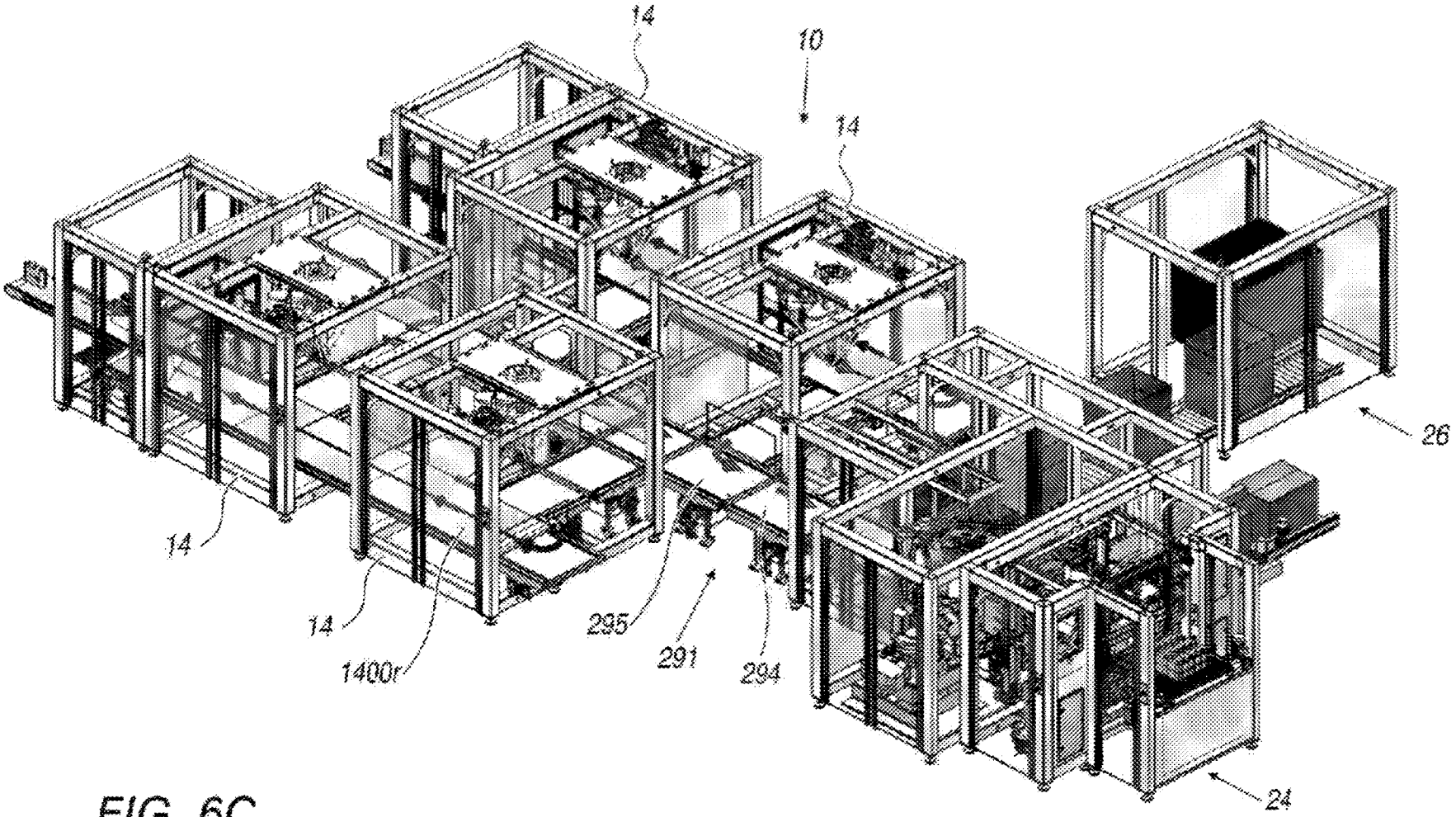
FIG. 6C illustrates a schematic, perspective view of the second preferred implementation of apparatus according to the present invention, in particular configured in accordance with a second version of the same implementation of apparatus.
Figure 6D:
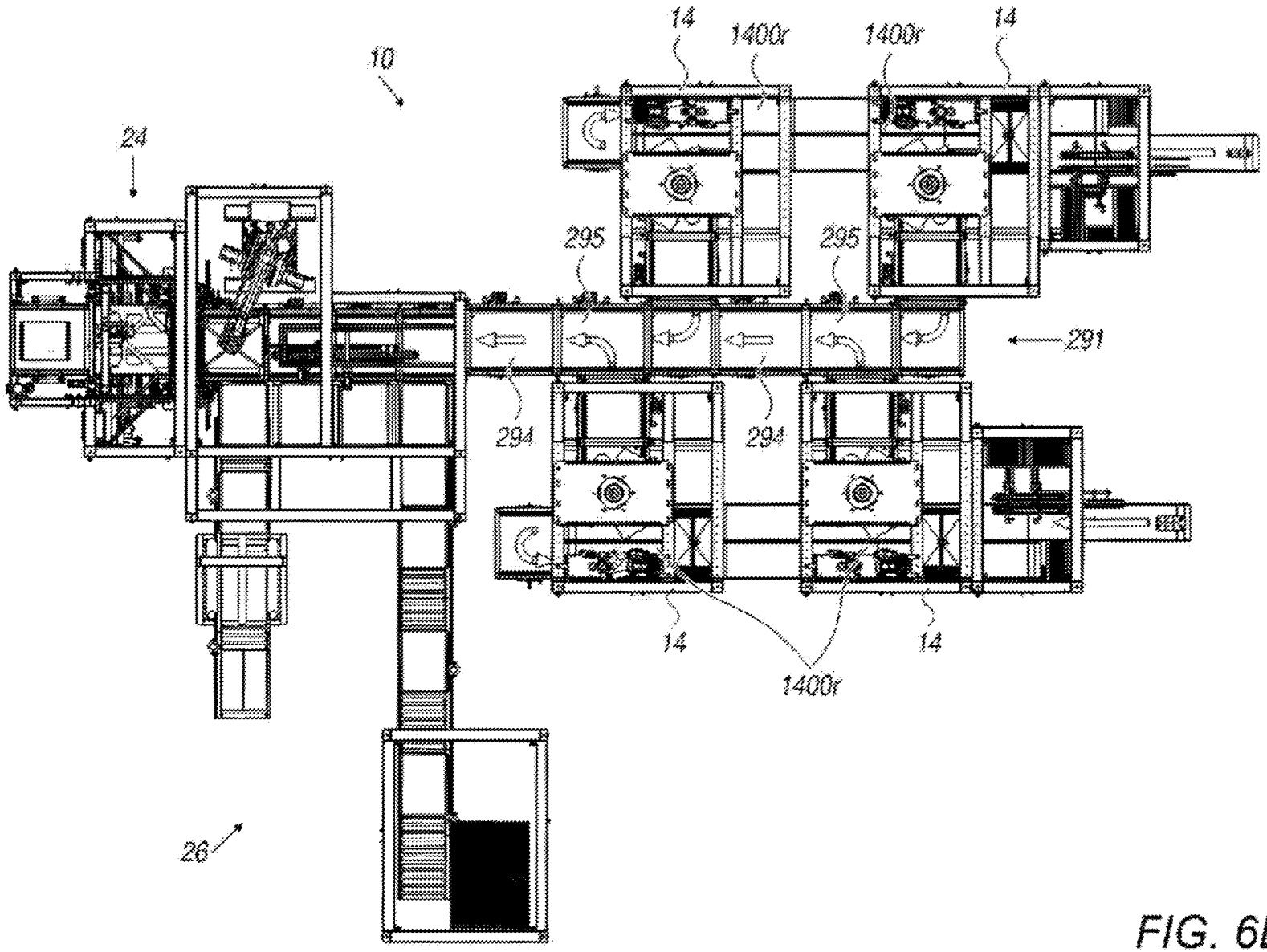
FIG. 6D illustrates a schematic, top plan view of the second preferred implementation of apparatus according to the present invention, in particular configured in accordance with the second version of the same implementation of apparatus.
Figure 7:
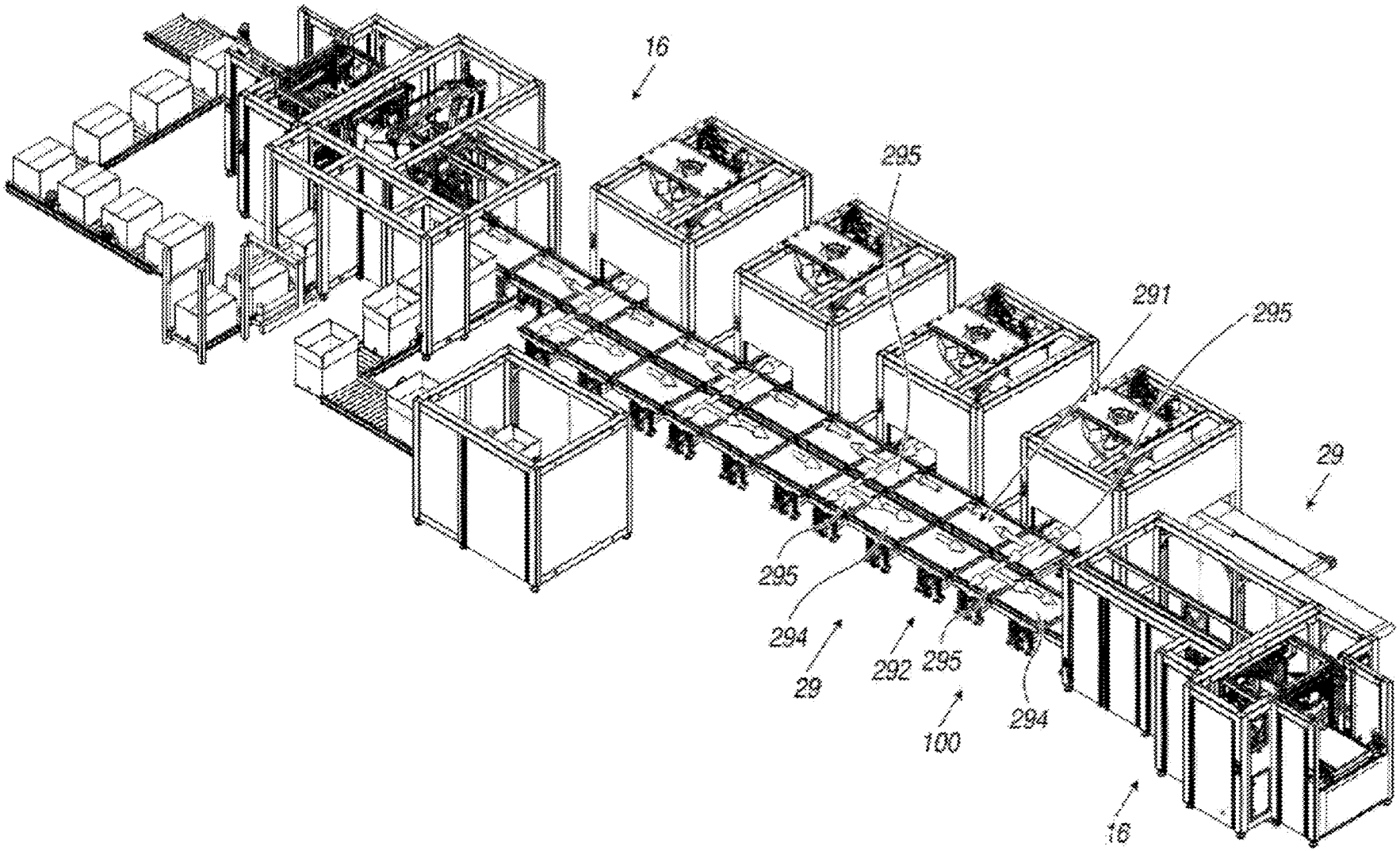
FIG. 7 illustrates a schematic, perspective view of the second preferred implementation of apparatus according to the present invention, in particular configured in accordance with a third version of the same implementation of apparatus.
Figure 8A:
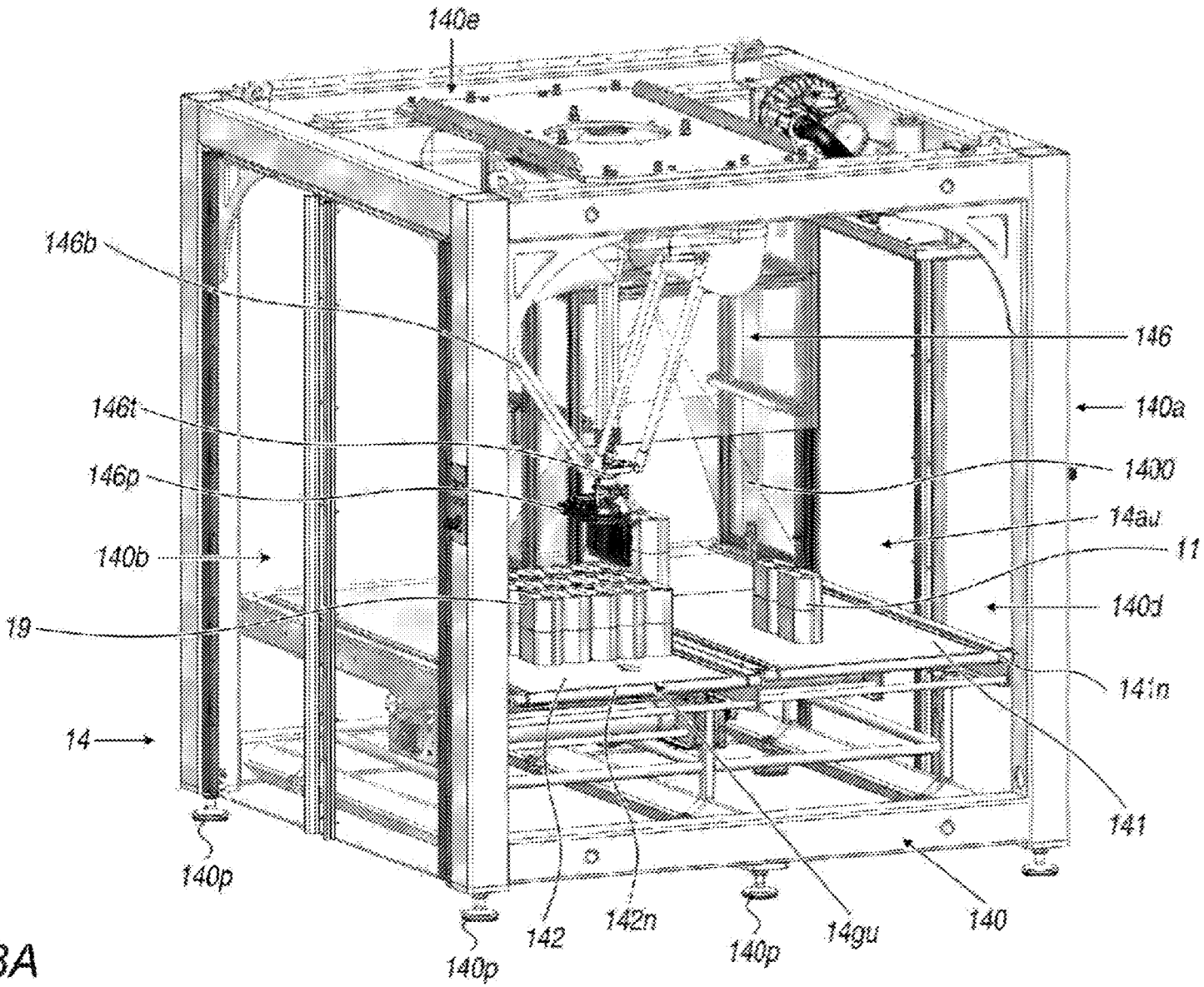
FIG. 8A illustrates a schematic, perspective view of a first preferred implementation of module for the preparation of a respective group of articles to be packaged, which can be used in the apparatus according to the present invention.
Figure 8B:
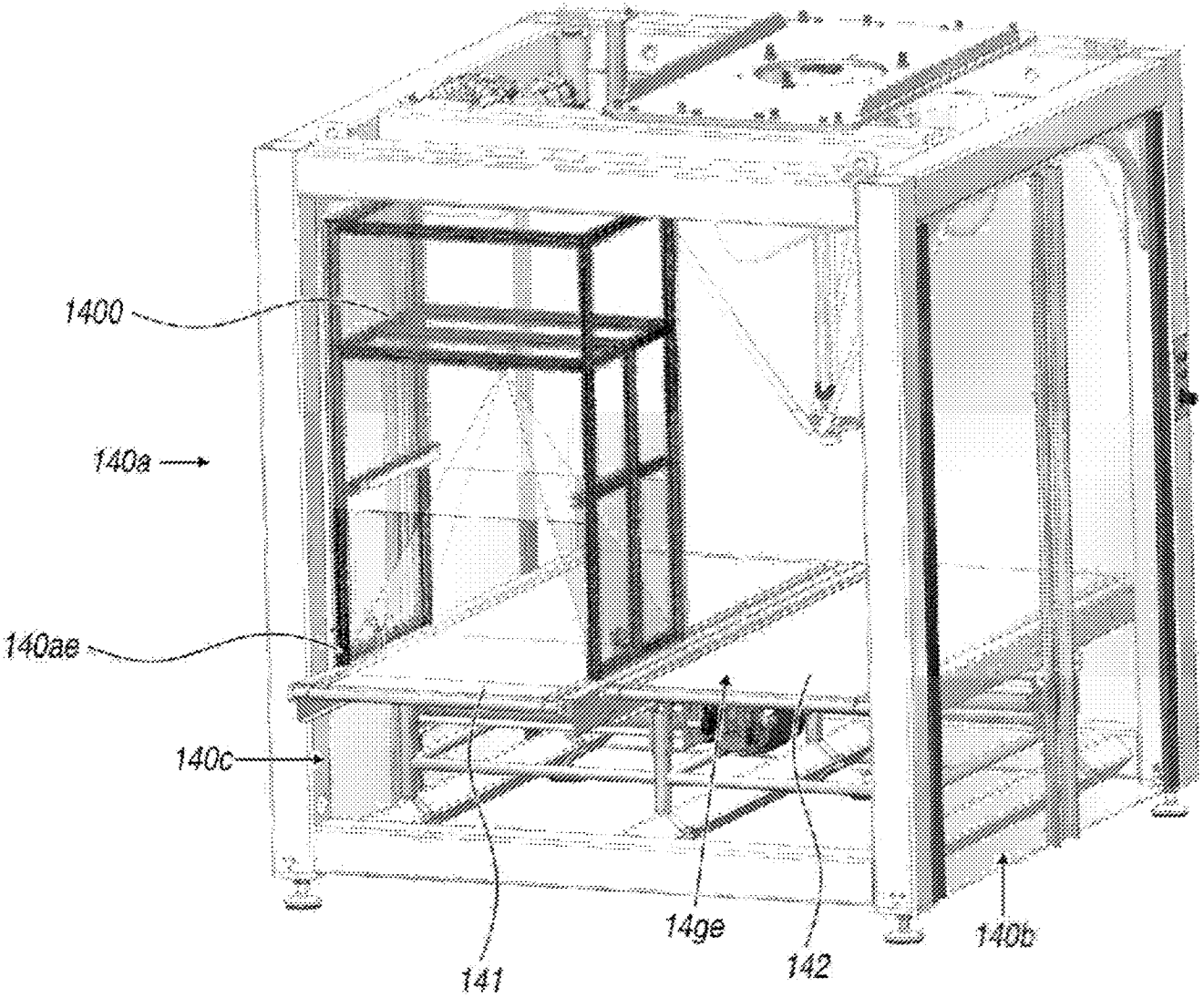
FIG. 8B illustrates a schematic, perspective view, taken from a different direction than that of FIG. 8A, of the first preferred implementation of module for the preparation of a respective group of articles to be packaged, which can be used in the apparatus according to the present invention.
Figure 9A:
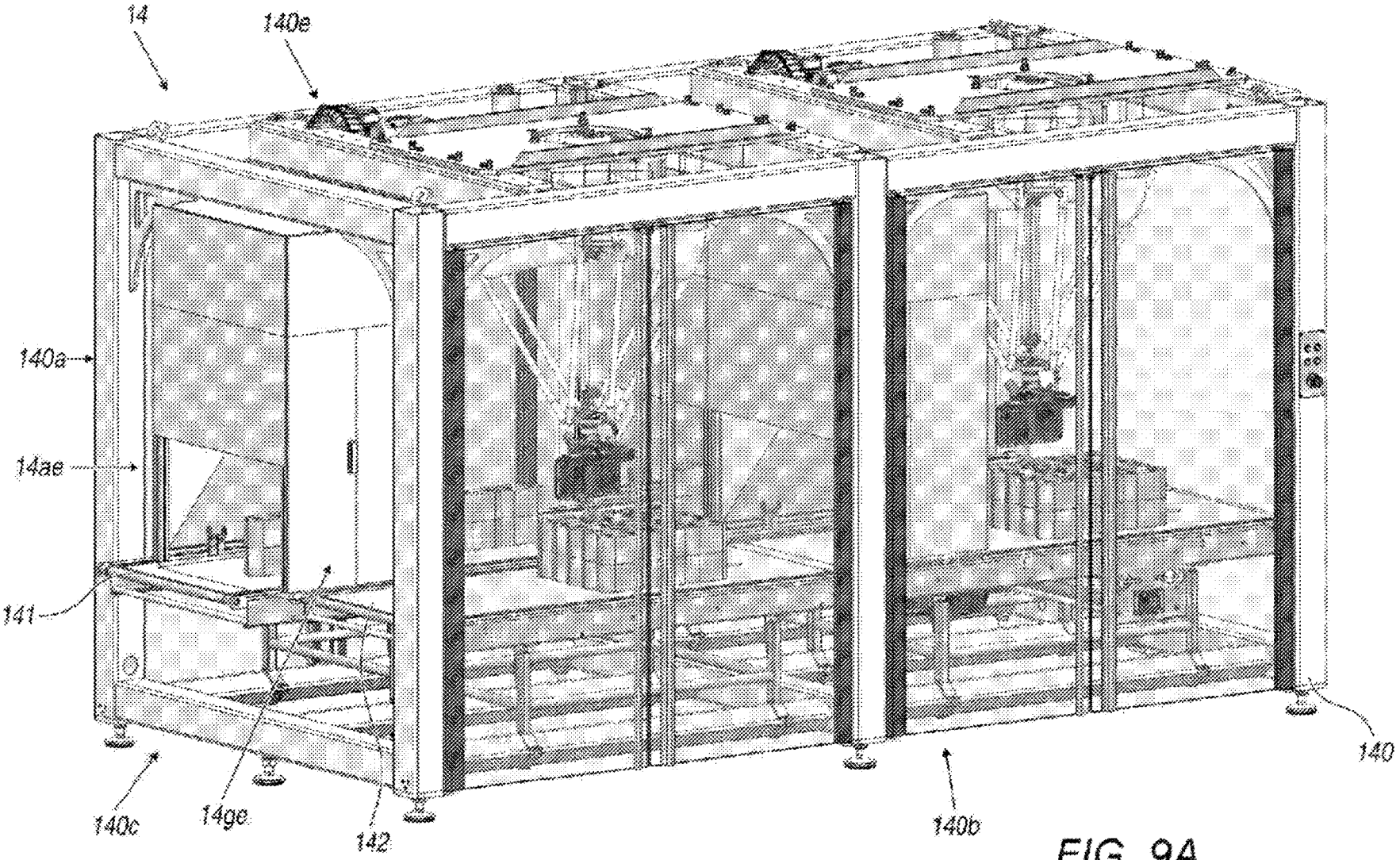
FIG. 9A illustrates a schematic, perspective view of a second preferred implementation of module for the preparation of a respective group of articles to be packaged, which can be used in the apparatus according to the present invention.
Figure 9B:
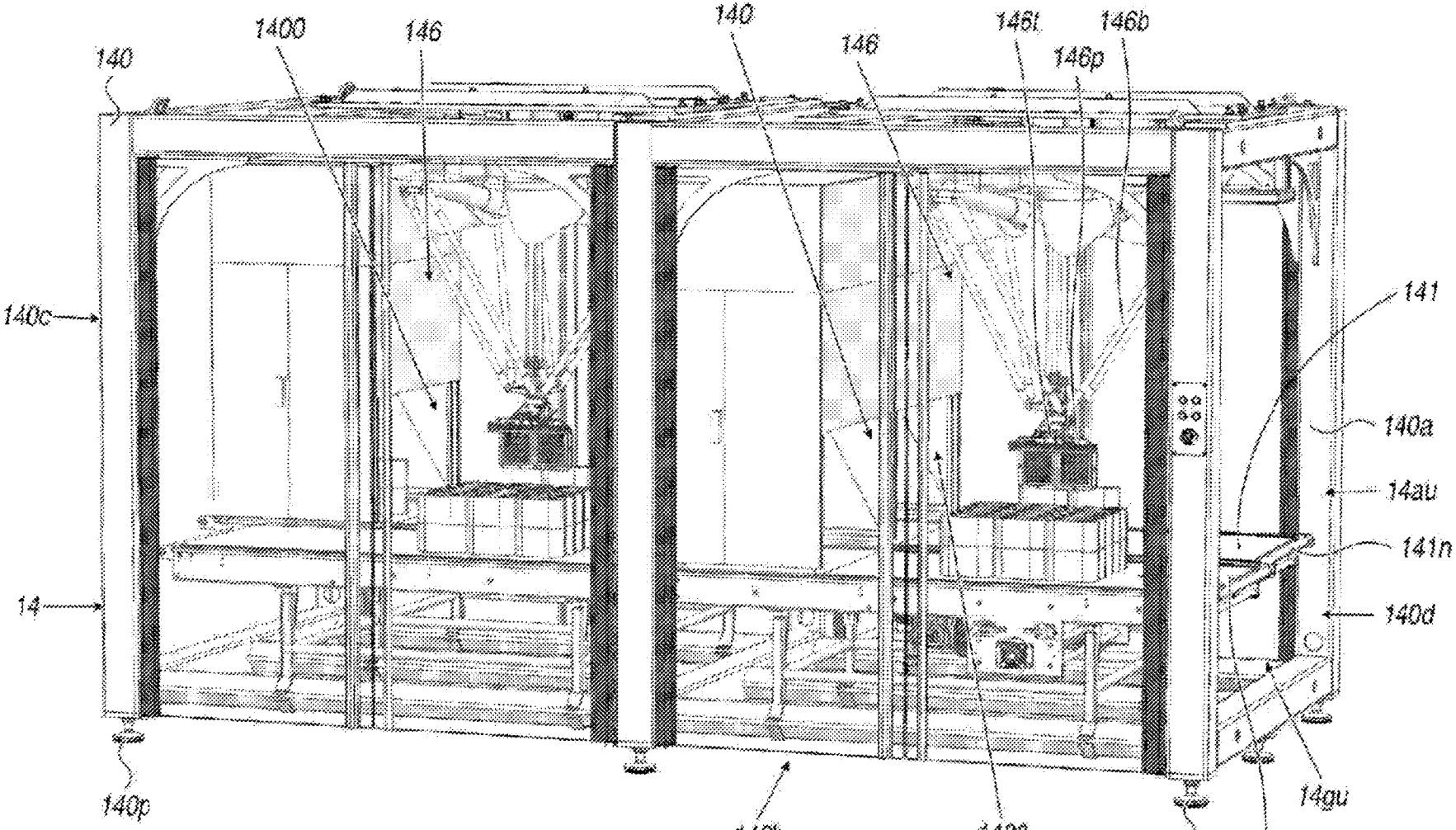
FIG. 9B illustrates a schematic, perspective view, taken from a different direction than that of FIG. 9A, of the second preferred implementation of module for the preparation of a respective group of articles to be packaged, which can be used in the apparatus according to the present invention.
Figure 9C:
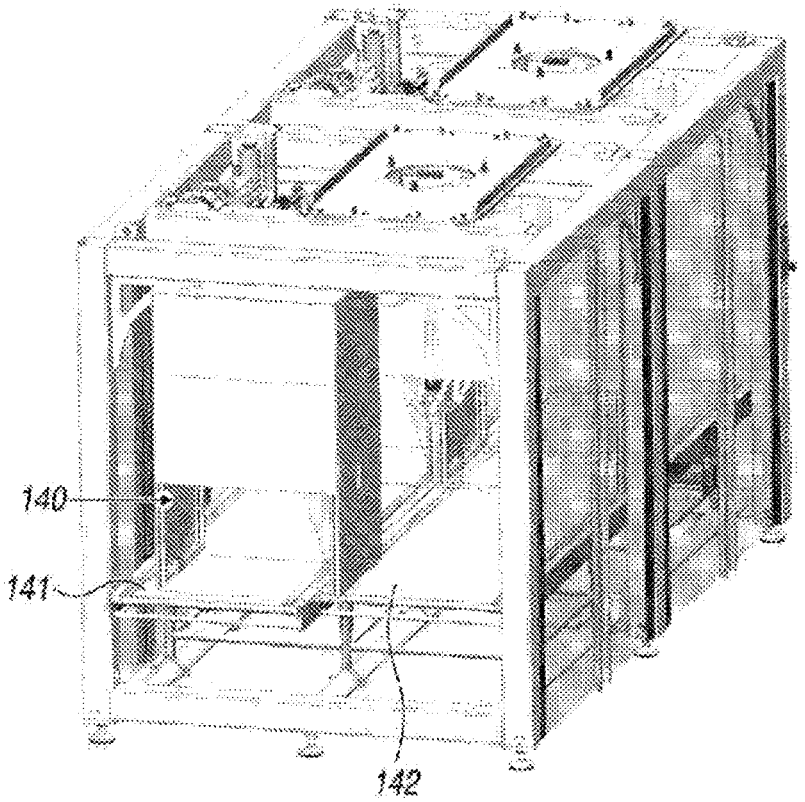
FIG. 9C illustrates a schematic, perspective view, taken from a different direction than that of FIGS. 9A and 9B, of the second preferred implementation of module for the preparation of a respective group of articles to be packaged, which can be used in the apparatus according to the present invention.
Figure 9D:
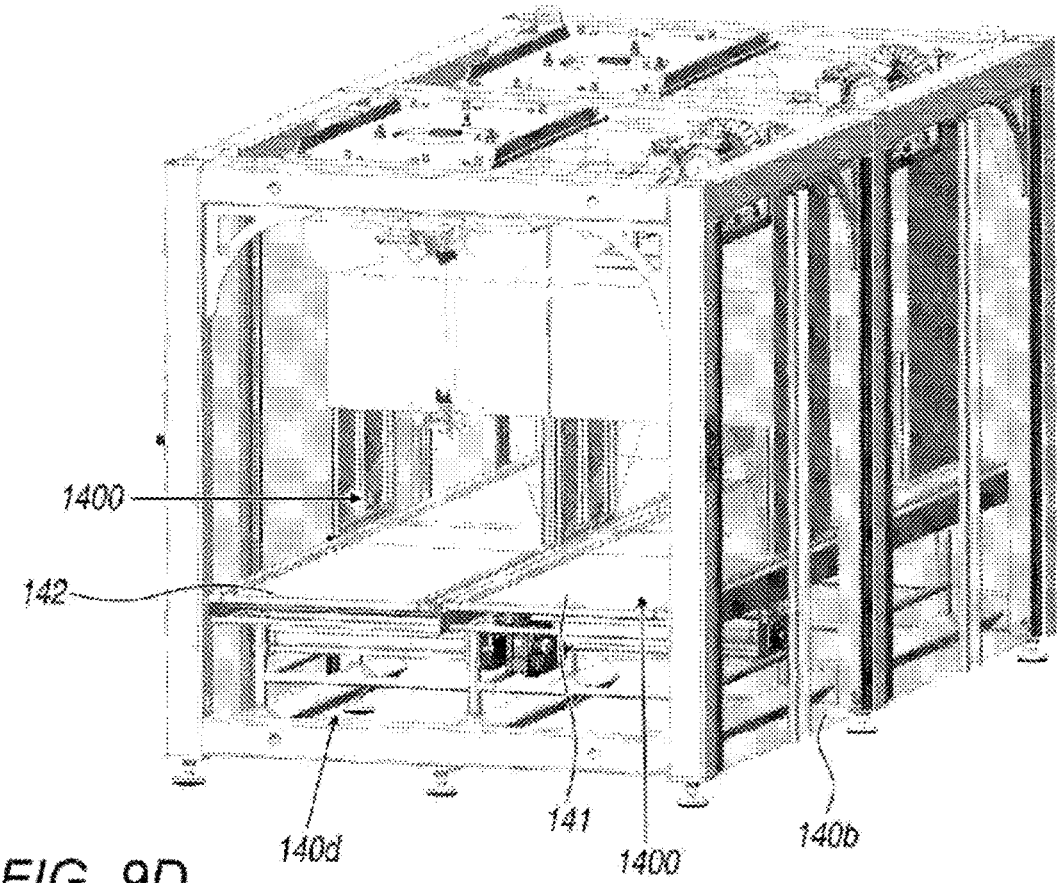
FIG. 9D illustrates a schematic, perspective view, taken from an opposite direction than that of FIG. 9D, of the second preferred implementation of module for the preparation of a respective group of articles to be packaged, which can be used in the apparatus according to the present invention.

As is clear from said FIGS. 6A to 7, advantageously, in accordance with a second preferred implementation 100 of apparatus, means 29 are provided, for the advancement of said groups of articles to be packaged 19 towards the corresponding means 16 for using 16 the respective group of articles to be packaged 19.

In particular, as is clear, the second preferred implementation 100 of apparatus, is illustrated in a first version, illustrated in the FIGS. 6A and 6B, in a second version, illustrated in the FIGS. 6C and 6D, and in a third version, in turn illustrated in FIG. 7.

In a particularly advantageous manner, as is clear from said FIGS. 6A to 7, said means 29 for the advancement of said groups of articles to be packaged 19 towards said means 16 for using the respective group of articles to be packaged 19 comprise, or are in the form of, a corresponding conveying line 291, 292, in particular longitudinally extending and/or rectilinear, in particular adapted to supply said groups of articles to be packaged 19 to at least one corresponding means for using 16.

Advantageously, as is clear from FIG. 7, in relation to a second version of the second preferred implementation 100, a first and a second conveying lines 291, 292 are provided, in particular being longitudinally extended and/or rectilinear, i.e., parallel and/or adjacent and placed side-by-side to one another, which first and second conveying lines 291, 292, are adapted to convey respective groups of articles to be packaged 19 according to different, in particular longitudinal opposite directions, and towards corresponding means for using 16, 16, which are especially mutually spaced apart.

As is clear from said FIGS. 6A to 7, advantageously, one or more modules, or units 14 are provided, which are adapted to prepare a respective group of articles to be packaged 19, in particular provided longitudinally mutually aligned and/or on a corresponding side of the respective conveying line 291, 292, and adapted to transfer the respective groups of articles to be packaged 19 to the same conveying line 291, 292 towards a corresponding means for using 16, preferably the respective conveying line 291, 292 extending parallel to the row defined by said modules, or units, 14 adapted to prepare a respective group of articles to be packaged 19.

As is clear from said FIGS. 6C and 6D, advantageously, modules, or units 14 are provided, adapted to prepare a respective group of articles to be packaged 19, at opposite sides of the respective conveying line 291, and adapted to transfer the respective groups of articles to be packaged 19 to the same conveying line 291.

In an appreciably advantageous manner, as is clear from said FIGS. 6A to 7, the respective conveying line 291, 292 comprises a plurality of conveyors, or conveyor belts 294, 295, in succession to one another and in particular longitudinally mutually aligned.

Advantageously, as is clear from said FIG. 7, said conveyors, or conveyor belts, of the respective conveying line 291, 292 towards a corresponding means for using 16, 16 comprise one or more conveyors, or conveyor belts, 294 for the longitudinal advancement and/or one or more conveyors, or conveyor belts, 295 for the longitudinal and transversal advancement, in particular interposed with one another, especially said conveyors, or conveyor belts, 295 for the longitudinal and transversal advancement allowing the insertion of the respective group of articles to be packaged 19 on the respective conveying line, in particular on the conveying line 292 that is interposed by the other conveying line 291 with respect to said one or more modules, or units, 14 for the preparation of the respective group of articles to be packaged 19.

As is clear from said FIGS. 6A to 7, advantageously, the respective conveying line 291, 292 extends parallel to said means 12 for the advancement of said articles 11 to be packaged.

With appreciable advantage, as is clear from said FIGS. 6A to 7, said means 12 for supplying said articles 11 comprise a plurality of conveyors, or conveyor belts, 121, in particular longitudinally mutually aligned, especially at least partially defined by the corresponding conveyor for supplying the respective module, or unit, 14 for the preparation of a respective group of articles to be packaged 19 of the apparatus.

Advantageously, as is clear from said FIGS. 6A to 7, said means 12 for supplying said articles 11 comprise a length 1200 for the recirculation of said articles 11 on the main supplying length 1201 onto which the respective module, or unit 14 operates for the preparation of a respective group of articles to be packaged 19.

As is clear from said FIGS. 6A to 7, advantageously, processor means are provided for driving the apparatus, or one or more respective module, or unit, thereof, in particular comprising, or defined by, the driving processor means 249 at said module, or unit, 24 adapted to package in a corresponding envelope, preferably to make a corresponding bag that holds these articles 11.

Advantageously, as is clear from said FIGS. 6C and 6D, in accordance with a fourth preferred implementation, the respective module, or unit, 14 for the preparation of a respective group of articles to be packaged 19 comprises, or supports, a corresponding conveyor, in particular in the form of a conveyor belt, 1400*r*, especially adapted to move said articles 11 according to a respective return direction, and especially being part of a recirculation line of said articles 11.

As is clear from said FIGS. 6C and 6D, with advantage, said return conveyor 1400*r*, in particular in the form of a conveyor belt, extends between opposite inlet and outlet ends from the treatment module, or unit 14, preferably at the opposite transversal sides 140*d*, 140*c* thereof, and is arranged parallel and/or adjacent and preferably coplanar to the conveyor, in particular in the form of a conveyor belt 141*n* which is adapted to supply said articles 11 in the supplying thereof.

In practice, as is apparent, the technical characteristics illustrated above allow, singularly or in a respective combination, to achieve one or more of the following advantageous results:

an apparatus particularly flexible to use is achieved;

by combining the different modules, it is possible to make an apparatus that is easily configured as a function of the specific needs of the users of the same apparatus;

the apparatus can be suitably configured as a function of the available space for the installation thereof within the plant of use;

the productivity or working speed can be suitably varied by adding or removing corresponding modules to the same apparatus;

the damage to said articles is avoided to the greatest extent of;

articles of any configurations can be processed, and groups of articles to be packaged of any configurations can be made;

an apparatus having a compact configuration and which takes a minimum space, can be achieved.

The present invention is susceptible of obvious industrial application. Furthermore, those skilled in the art will be able to devise a number of modifications and/or variations to be made to the same invention, while remaining within the scope of the inventive concept, as widely explained. Furthermore, those skilled in the art will be able to devise further preferred implementations of the invention, which comprise one or more of the characteristics illustrated above of the preferred implementation referred to above, in particular, as set forth in the attached claims. Furthermore, it shall also be understood that all the details of the invention can be replaced by technically equivalent elements.

The invention claimed is:

1. An apparatus for packaging articles into a package, said articles being composed of one or more products, said products being in the form of rolls, the apparatus comprising:

a supplying device for supplying said articles, the supplying device including at least one conveyor;

a preparing device for preparing groups of articles to be packaged, the preparing device including at least one robot for forming the group of articles on a supporting surface;

a packaging device of the respective group of articles to be packaged, the packaging device including a wrapping device;

a plurality of independent, or discrete, treatment modules or units for treating said articles, which treatment modules or units are situated in a sequential manner or in a succession to one another, to provide for the packaging of the articles, through the preparation of the groups of articles, to provide a packaged group of articles;

wherein at least one of said treatment modules or units is the preparing device, the preparing device comprising a first autonomous supporting frame and having a first inlet for a respective one of the articles and a first outlet for a respective one of the groups of articles; and wherein at least another one of said treatment modules or units, separate from the preparing device is the packaging device, the packaging device comprising a second autonomous supporting frame and having a second inlet for the respective one of the groups of articles and a second outlet for the packaged group of articles.

2. The apparatus according to claim 1, wherein at least one of said treatment modules or units comprises an advancement device for advancing said products to be packaged, the advancement device including at least one further conveyor.

3. The apparatus according to claim 1, wherein the at least one of said treatment modules or units comprises a supporting frame of the advancement device.

4. The apparatus according to claim 1, wherein at least certain of said treatment modules or units each comprise at least one inlet and at least one outlet for the articles and/or groups of articles, wherein the at least one outlet of one of the at least certain of said treatment modules or units is operatively connected with the at least one inlet of a subsequent one of the at least certain of said treatment modules or units.

5. The apparatus according to claim 1, wherein at least one of said treatment modules or units includes an outlet for articles not used therein.

6. The apparatus according to claim 1, wherein at least one of said treatment modules or units includes a detecting device, including at least one camera, for detecting said articles and/or said groups of articles to be packaged, for detecting an arrangement or configuration of said articles and/or said groups of articles to be packaged being formed, and detecting any defects of said articles and/or of the respective groups of articles to be packaged.

7. The apparatus according to claim 1, and further comprising a recirculating conveyor provided with the supplying device for recirculating non-used articles from said preparing device.

8. The apparatus according to claim 1, wherein said preparing device comprises one or more preparing modules or units adapted to prepare a respective group of articles to be packaged.

9. The apparatus according to claim 8, wherein said one or more preparing modules or units comprises a supporting frame configured for positioning on a floor via support feet.

10. The apparatus according to claim 9, wherein said supporting frame includes a front longitudinal side, a rear longitudinal side, a head transversal side, facing, in use, a unit arranged upstream of said apparatus, and a tail transversal side, facing, in use, a unit arranged downstream of said apparatus.

11. The apparatus according to claim 9, wherein said supporting frame is at least partially open on the head transversal side, to define an inlet for the articles and/or groups of articles to be processed therein, and is at least partially open on the tail transversal side to define an outlet of the groups of articles processed therein or an outlet of articles that are not used therein.

12. The apparatus according to claim 9, wherein said supporting frame is at least partially open on the respective head transversal side, to define an inlet for the articles to be processed therein, and is at least partially open on the front longitudinal side, to define an outlet of said group of articles to be packaged, and is at least partially open on the tail transversal side to define an outlet of articles, that are not used therein.

13. The apparatus according to claim 8, wherein said supporting surface extends longitudinally between an inlet and an outlet of the preparing device.

14. The apparatus according to claim 13, wherein said supporting surface is at least partly formed by an upper face of a conveyor belt adapted to move said articles in a respective longitudinal direction.

15. The apparatus according to claim 14, wherein said conveyor belt extends between an inlet and an outlet of the preparing device.

16. The apparatus according to claim 8, wherein said supporting surface extends transversely toward an outlet of the preparing device.

17. The apparatus according to claim 16, wherein said supporting surface is at least partly formed by an upper face of a conveyor belt, adapted to move the groups of articles forward while arranged on the conveyor belt transversely to a direction of advancement of the conveyor belt while arranged on the conveyor belt transversely to a direction of advancement of the conveyor belt.

* * * * *